US007146113B2

(12) United States Patent
Kitamura

(10) Patent No.: US 7,146,113 B2
(45) Date of Patent: Dec. 5, 2006

(54) IMAGE FORMING APPARATUS TO WHICH A SHEET DISCHARGE DEVICE CAN BE DETACHABLY MOUNTED

(75) Inventor: Toshifumi Kitamura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 271 days.

(21) Appl. No.: 10/868,584

(22) Filed: Jun. 14, 2004

(65) Prior Publication Data

US 2004/0253009 A1 Dec. 16, 2004

(30) Foreign Application Priority Data

Jun. 16, 2003 (JP) ..... 2003-170823
May 25, 2004 (JP) ..... 2004-154840

(51) Int. Cl.
*G03G 15/00* (2006.01)

(52) U.S. Cl. ..... 399/13; 399/407

(58) Field of Classification Search ..... 399/13, 399/396, 401, 405–410
See application file for complete search history.

(56) References Cited

U.S. PATENT DOCUMENTS 6,973,286 B1 * 12/2005 Mandel et al. ..... 399/391

FOREIGN PATENT DOCUMENTS

JP 09-221254 A 8/1997
JP 2002211794 A * 7/2002

* cited by examiner

*Primary Examiner*—David M. Gray
*Assistant Examiner*—Ryan Gleitz
(74) *Attorney, Agent, or Firm*—Canon U.S.A. Inc. IP Division

(57) ABSTRACT

An image forming apparatus is provided which includes an image formation unit for forming images on a recording medium; a first transporting path for discharging a recording medium to a sheet discharge device; a longer second transporting path for reversing the transportation direction of the recording medium; a transporting path switching unit for switching between the first transporting path or the second transporting path; a setting unit for setting the discharge speed for discharging the recording medium from the first and second transporting paths to a recording sheet stacking unit, and also setting the reverse transportation speed; and a determining unit for determining whether or not the sheet discharge device has been connected to the image forming apparatus; wherein the setting unit sets a first discharge speed slower than the reverse transportation speed in the event that the sheet discharge device has not been connected, and otherwise sets a faster second discharge speed.

20 Claims, 16 Drawing Sheets

| PAGE ID | FD/FU SPECIFICATION | SHEET SUPPLY OPENING SPECIFICATION | SHEET SIZE SPECIFICATION |
|---|---|---|---|
| 1 | FD | CASSETTE | A4 |
| 2 | FD | CASSETTE | A4 |
| 3 | FD | CASSETTE | A4 |
| 4 | FD | CASSETTE | A4 |
| 5 | FD | CASSETTE | A4 |
| 6 | FD | CASSETTE | A4 |
| 7 | FD | CASSETTE | A4 |
| 8 | FD | CASSETTE | A4 |
| 9 | FU | MP TRAY | A4 |
| 10 | FU | MP TRAY | A4 |

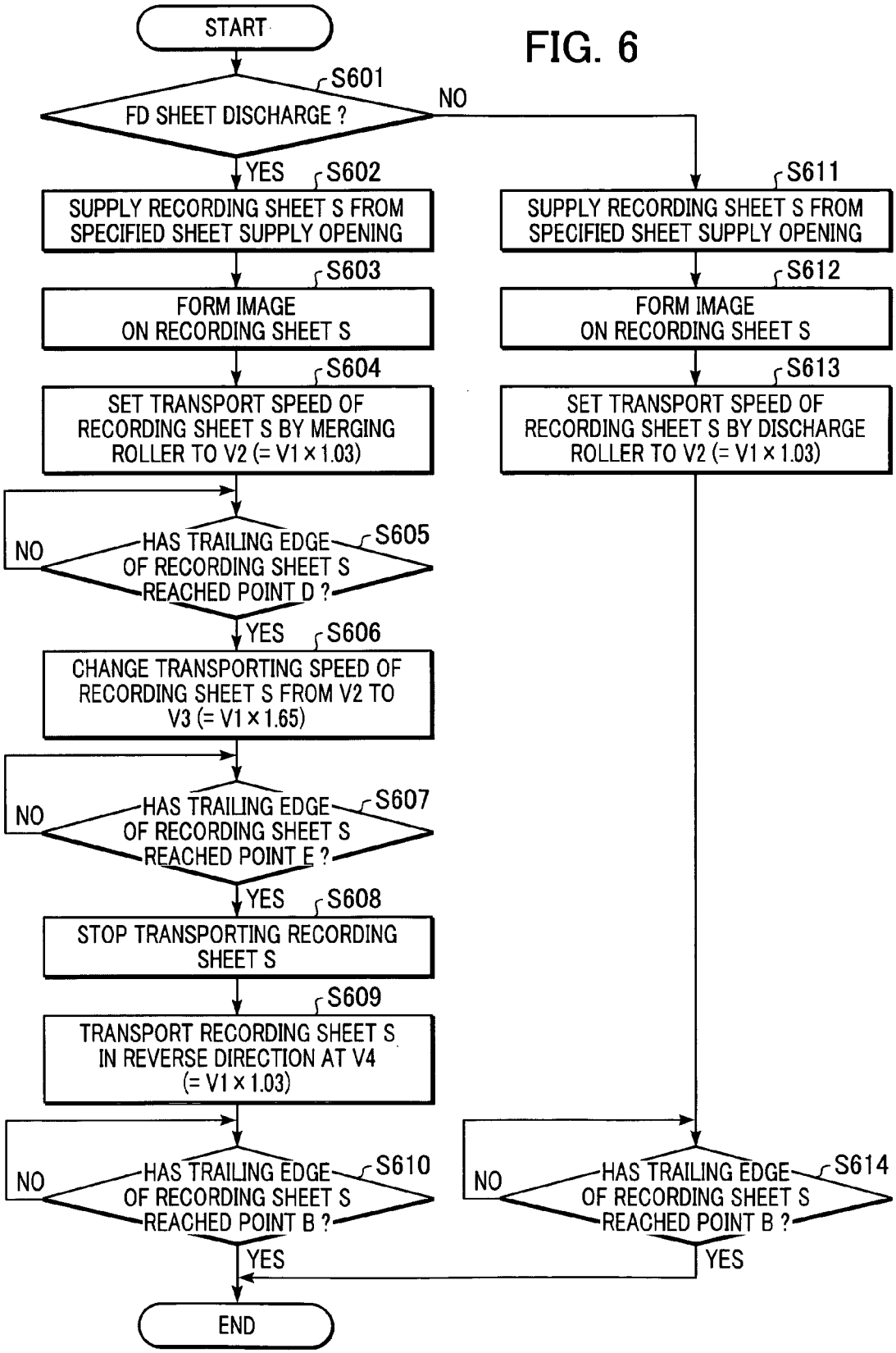
FIG. 6
START
S601
FD SHEET DISCHARGE ?
NO
YES
S602
SUPPLY RECORDING SHEET S FROM SPECIFIED SHEET SUPPLY OPENING
S603
FORM IMAGE ON RECORDING SHEET S
S604
SET TRANSPORT SPEED OF RECORDING SHEET S BY MERGING ROLLER TO V2 (= V1 × 1.03)
S605
HAS TRAILING EDGE OF RECORDING SHEET S REACHED POINT D ?
NO
YES
S606
CHANGE TRANSPORTING SPEED OF RECORDING SHEET S FROM V2 TO V3 (= V1 × 1.65)
S607
HAS TRAILING EDGE OF RECORDING SHEET S REACHED POINT E ?
NO
YES
S608
STOP TRANSPORTING RECORDING SHEET S
S609
TRANSPORT RECORDING SHEET S IN REVERSE DIRECTION AT V4 (= V1 × 1.03)
S610
HAS TRAILING EDGE OF RECORDING SHEET S REACHED POINT B ?
NO
YES
S611
SUPPLY RECORDING SHEET S FROM SPECIFIED SHEET SUPPLY OPENING
S612
FORM IMAGE ON RECORDING SHEET S
S613
SET TRANSPORT SPEED OF RECORDING SHEET S BY DISCHARGE ROLLER TO V2 (= V1 × 1.03)
S614
HAS TRAILING EDGE OF RECORDING SHEET S REACHED POINT B ?
NO
YES
END

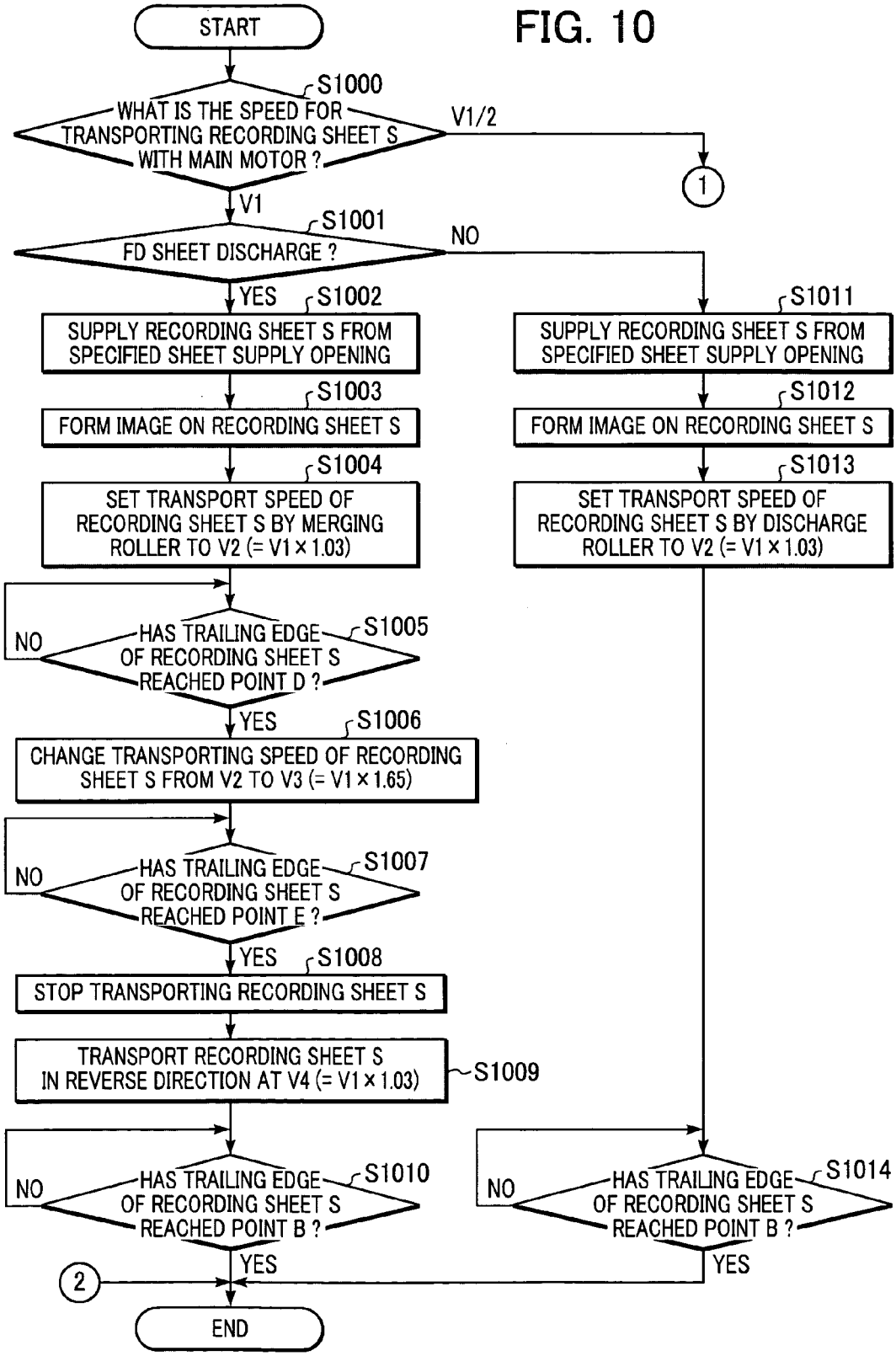
FIG. 10
START
S1000
WHAT IS THE SPEED FOR TRANSPORTING RECORDING SHEET S WITH MAIN MOTOR ?
V1/2
1
V1
S1001
FD SHEET DISCHARGE ?
NO
YES
S1002
SUPPLY RECORDING SHEET S FROM SPECIFIED SHEET SUPPLY OPENING
S1003
FORM IMAGE ON RECORDING SHEET S
S1004
SET TRANSPORT SPEED OF RECORDING SHEET S BY MERGING ROLLER TO V2 (= V1 × 1.03)
S1005
HAS TRAILING EDGE OF RECORDING SHEET S REACHED POINT D ?
NO
YES
S1006
CHANGE TRANSPORTING SPEED OF RECORDING SHEET S FROM V2 TO V3 (= V1 × 1.65)
S1007
HAS TRAILING EDGE OF RECORDING SHEET S REACHED POINT E ?
NO
YES
S1008
STOP TRANSPORTING RECORDING SHEET S
TRANSPORT RECORDING SHEET S IN REVERSE DIRECTION AT V4 (= V1 × 1.03)
S1009
S1010
HAS TRAILING EDGE OF RECORDING SHEET S REACHED POINT B ?
NO
YES
2
END
S1011
SUPPLY RECORDING SHEET S FROM SPECIFIED SHEET SUPPLY OPENING
S1012
FORM IMAGE ON RECORDING SHEET S
S1013
SET TRANSPORT SPEED OF RECORDING SHEET S BY DISCHARGE ROLLER TO V2 (= V1 × 1.03)
S1014
HAS TRAILING EDGE OF RECORDING SHEET S REACHED POINT B ?
NO
YES

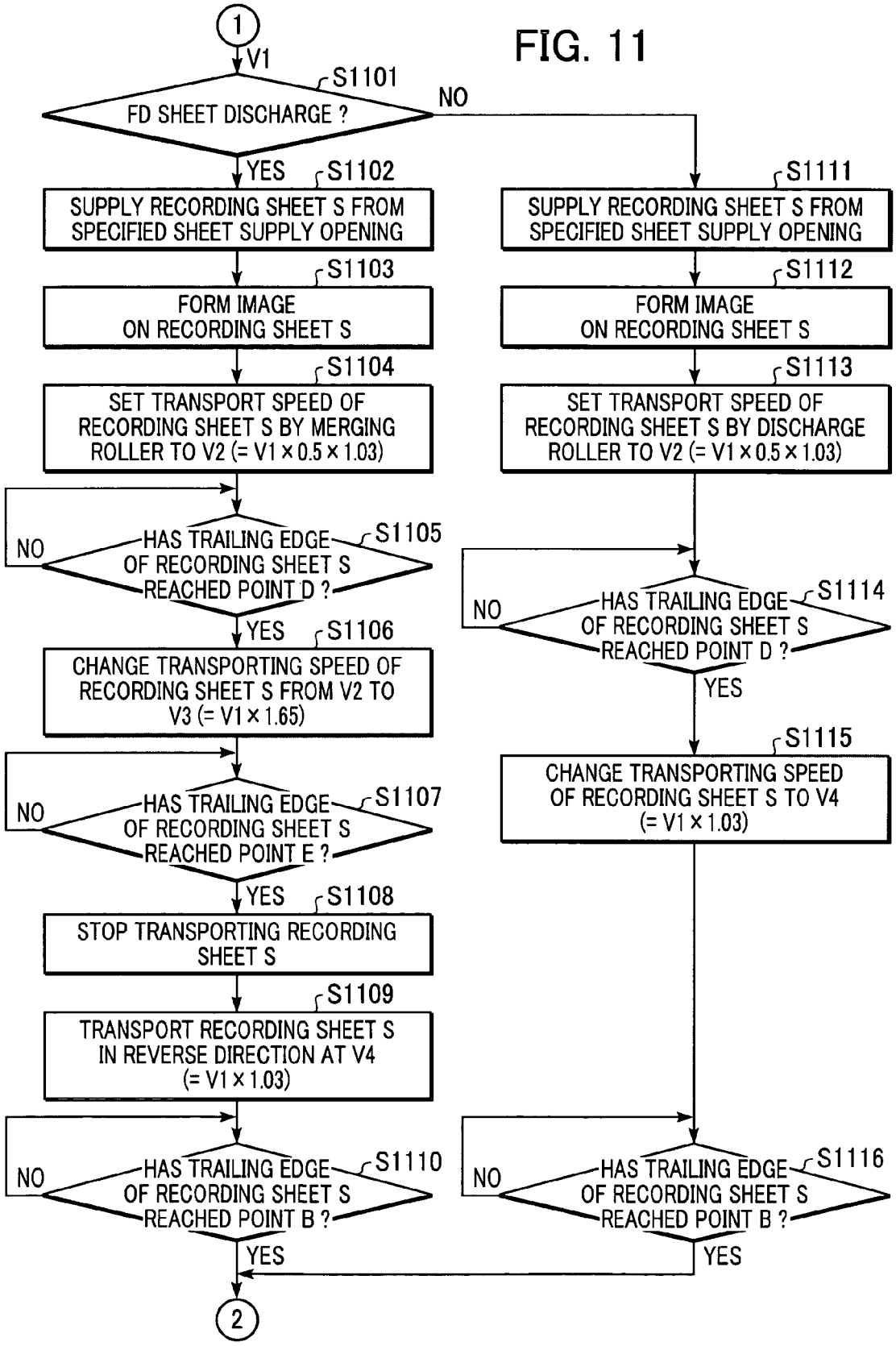
FIG. 11
1
V1
S1101
FD SHEET DISCHARGE ?
NO
YES
S1102
SUPPLY RECORDING SHEET S FROM SPECIFIED SHEET SUPPLY OPENING
S1103
FORM IMAGE ON RECORDING SHEET S
S1104
SET TRANSPORT SPEED OF RECORDING SHEET S BY MERGING ROLLER TO V2 (= V1 × 0.5 × 1.03)
S1105
HAS TRAILING EDGE OF RECORDING SHEET S REACHED POINT D ?
NO
YES
S1106
CHANGE TRANSPORTING SPEED OF RECORDING SHEET S FROM V2 TO V3 (= V1 × 1.65)
S1107
HAS TRAILING EDGE OF RECORDING SHEET S REACHED POINT E ?
NO
YES
S1108
STOP TRANSPORTING RECORDING SHEET S
S1109
TRANSPORT RECORDING SHEET S IN REVERSE DIRECTION AT V4 (= V1 × 1.03)
S1110
HAS TRAILING EDGE OF RECORDING SHEET S REACHED POINT B ?
NO
YES
S1111
SUPPLY RECORDING SHEET S FROM SPECIFIED SHEET SUPPLY OPENING
S1112
FORM IMAGE ON RECORDING SHEET S
S1113
SET TRANSPORT SPEED OF RECORDING SHEET S BY DISCHARGE ROLLER TO V2 (= V1 × 0.5 × 1.03)
S1114
HAS TRAILING EDGE OF RECORDING SHEET S REACHED POINT D ?
NO
YES
S1115
CHANGE TRANSPORTING SPEED OF RECORDING SHEET S TO V4 (= V1 × 1.03)
S1116
HAS TRAILING EDGE OF RECORDING SHEET S REACHED POINT B ?
NO
YES
2

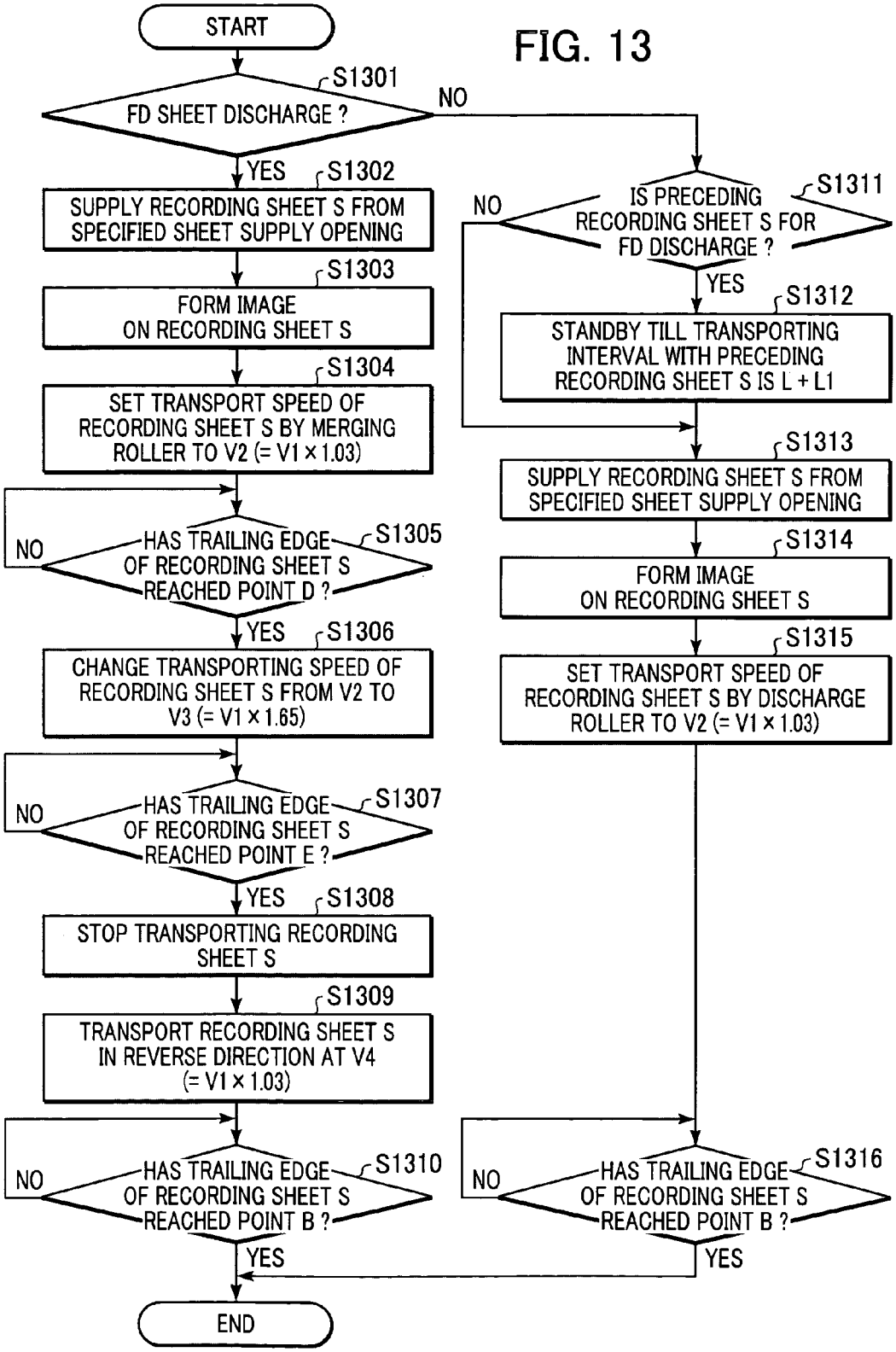
FIG. 13
START
S1301
FD SHEET DISCHARGE ?
NO
YES
S1302
SUPPLY RECORDING SHEET S FROM SPECIFIED SHEET SUPPLY OPENING
S1303
FORM IMAGE ON RECORDING SHEET S
S1304
SET TRANSPORT SPEED OF RECORDING SHEET S BY MERGING ROLLER TO V2 (= V1 × 1.03)
S1305
HAS TRAILING EDGE OF RECORDING SHEET S REACHED POINT D ?
NO
YES
S1306
CHANGE TRANSPORTING SPEED OF RECORDING SHEET S FROM V2 TO V3 (= V1 × 1.65)
S1307
HAS TRAILING EDGE OF RECORDING SHEET S REACHED POINT E ?
NO
YES
S1308
STOP TRANSPORTING RECORDING SHEET S
S1309
TRANSPORT RECORDING SHEET S IN REVERSE DIRECTION AT V4 (= V1 × 1.03)
S1310
HAS TRAILING EDGE OF RECORDING SHEET S REACHED POINT B ?
NO
YES
S1311
IS PRECEDING RECORDING SHEET S FOR FD DISCHARGE ?
NO
YES
S1312
STANDBY TILL TRANSPORTING INTERVAL WITH PRECEDING RECORDING SHEET S IS L + L1
S1313
SUPPLY RECORDING SHEET S FROM SPECIFIED SHEET SUPPLY OPENING
S1314
FORM IMAGE ON RECORDING SHEET S
S1315
SET TRANSPORT SPEED OF RECORDING SHEET S BY DISCHARGE ROLLER TO V2 (= V1 × 1.03)
S1316
HAS TRAILING EDGE OF RECORDING SHEET S REACHED POINT B ?
NO
YES
END

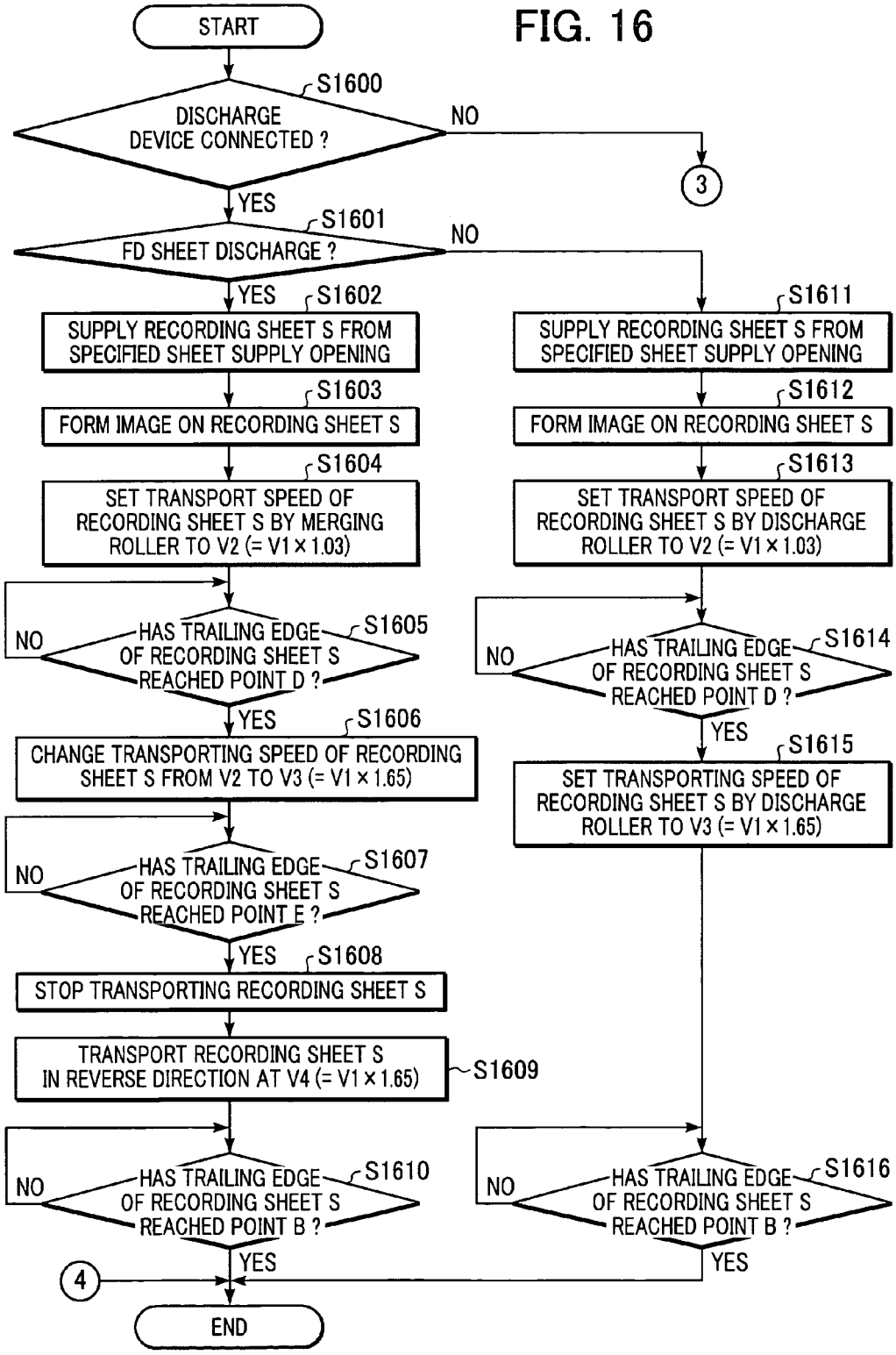
FIG. 16
START
S1600
DISCHARGE DEVICE CONNECTED ?
NO
3
YES
S1601
FD SHEET DISCHARGE ?
NO
YES
S1602
SUPPLY RECORDING SHEET S FROM SPECIFIED SHEET SUPPLY OPENING
S1603
FORM IMAGE ON RECORDING SHEET S
S1604
SET TRANSPORT SPEED OF RECORDING SHEET S BY MERGING ROLLER TO V2 (= V1 × 1.03)
S1605
HAS TRAILING EDGE OF RECORDING SHEET S REACHED POINT D ?
NO
YES
S1606
CHANGE TRANSPORTING SPEED OF RECORDING SHEET S FROM V2 TO V3 (= V1 × 1.65)
S1607
HAS TRAILING EDGE OF RECORDING SHEET S REACHED POINT E ?
NO
YES
S1608
STOP TRANSPORTING RECORDING SHEET S
S1609
TRANSPORT RECORDING SHEET S IN REVERSE DIRECTION AT V4 (= V1 × 1.65)
S1610
HAS TRAILING EDGE OF RECORDING SHEET S REACHED POINT B ?
NO
YES
4
END
S1611
SUPPLY RECORDING SHEET S FROM SPECIFIED SHEET SUPPLY OPENING
S1612
FORM IMAGE ON RECORDING SHEET S
S1613
SET TRANSPORT SPEED OF RECORDING SHEET S BY DISCHARGE ROLLER TO V2 (= V1 × 1.03)
S1614
HAS TRAILING EDGE OF RECORDING SHEET S REACHED POINT D ?
NO
YES
S1615
SET TRANSPORTING SPEED OF RECORDING SHEET S BY DISCHARGE ROLLER TO V3 (= V1 × 1.65)
S1616
HAS TRAILING EDGE OF RECORDING SHEET S REACHED POINT B ?
NO
YES

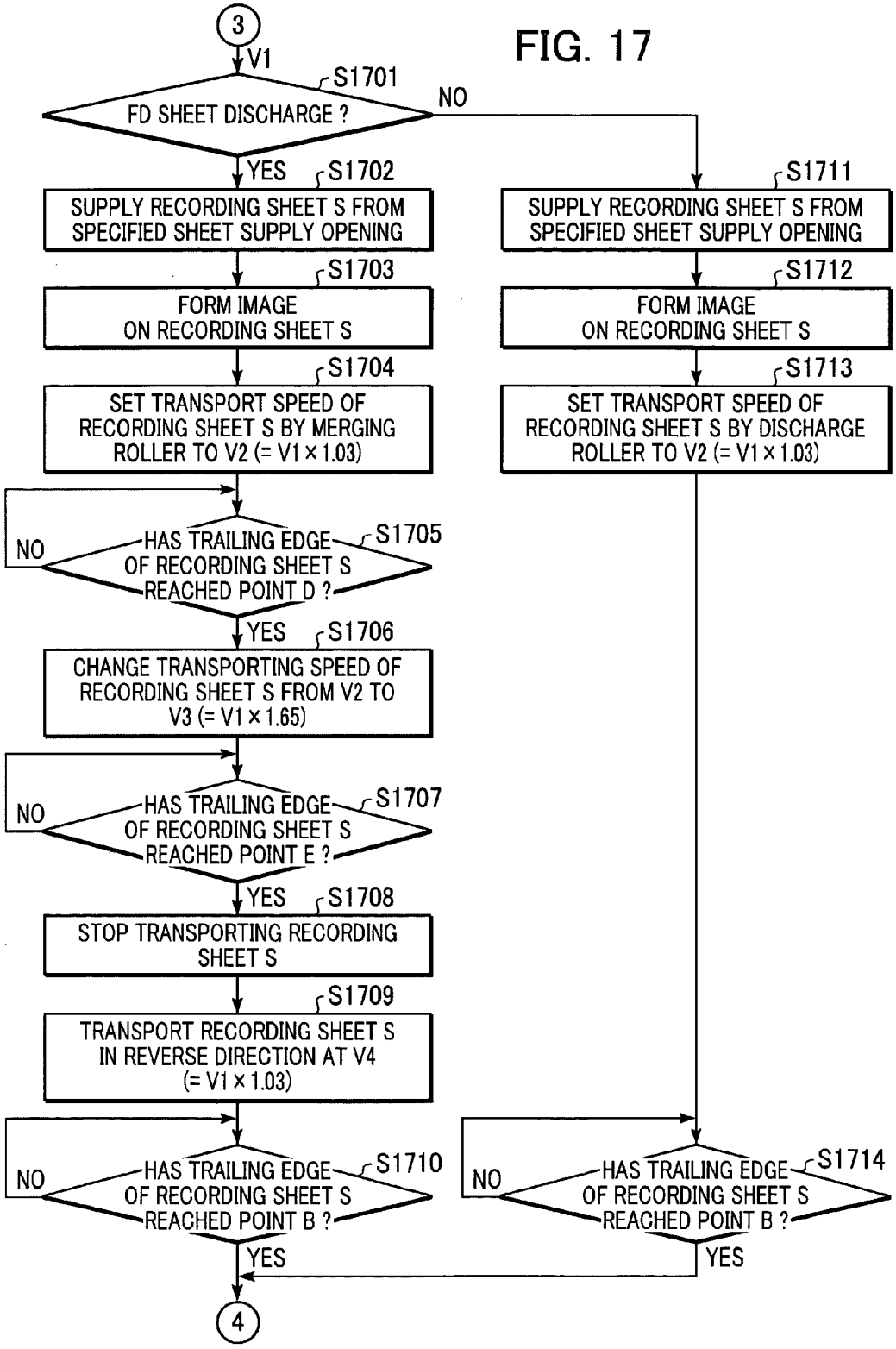
FIG. 17
3
V1
S1701
FD SHEET DISCHARGE ?
NO
YES
S1702
SUPPLY RECORDING SHEET S FROM SPECIFIED SHEET SUPPLY OPENING
S1703
FORM IMAGE ON RECORDING SHEET S
S1704
SET TRANSPORT SPEED OF RECORDING SHEET S BY MERGING ROLLER TO V2 (= V1 × 1.03)
S1705
HAS TRAILING EDGE OF RECORDING SHEET S REACHED POINT D ?
NO
YES
S1706
CHANGE TRANSPORTING SPEED OF RECORDING SHEET S FROM V2 TO V3 (= V1 × 1.65)
S1707
HAS TRAILING EDGE OF RECORDING SHEET S REACHED POINT E ?
NO
YES
S1708
STOP TRANSPORTING RECORDING SHEET S
S1709
TRANSPORT RECORDING SHEET S IN REVERSE DIRECTION AT V4 (= V1 × 1.03)
S1710
HAS TRAILING EDGE OF RECORDING SHEET S REACHED POINT B ?
NO
YES
S1711
SUPPLY RECORDING SHEET S FROM SPECIFIED SHEET SUPPLY OPENING
S1712
FORM IMAGE ON RECORDING SHEET S
S1713
SET TRANSPORT SPEED OF RECORDING SHEET S BY DISCHARGE ROLLER TO V2 (= V1 × 1.03)
S1714
HAS TRAILING EDGE OF RECORDING SHEET S REACHED POINT B ?
NO
YES
4

IMAGE FORMING APPARATUS TO WHICH A SHEET DISCHARGE DEVICE CAN BE DETACHABLY MOUNTED

BACKGROUND OF THE INVENTION

1. Field of the Invention

The present invention relates to an image forming apparatus.

2. Description of the Related Art

There have been conventionally known image forming apparatuses which use electrophotography and so forth to form images on recording media. Of these, with compact photocopiers in particular, in the event that multiple copies are consecutively made on recording media (recording sheets), the recording media with images formed on one side is generally discharged onto a stacking tray disposed at one end of the image forming apparatus in a face-up manner, that is to say, with the side of the sheet on which the image has been formed facing upwards.

Face-up discharging photocopiers are advantageous in that users can readily recognize images formed on the recording media, and in that the height of the apparatus can be suppressed even in the event that an image reading device for reading originals is disposed on top of the apparatus, since no sheet discharge unit is provided above the apparatus.

However, there is the problem that discharging sheets face-up at all times means that multiple copies made will be stacked on the discharge tray in the reverse order to that desired, and a stack of copies in the order in which the copies were made cannot be received by the user.

Accordingly, a photocopier having a reversal mechanism has been proposed, wherein sheets can be discharged onto the discharge tray at the end of the apparatus either face-up or face-down, as desired (see Japanese Patent Laid-Open No. 09-221254).

However, the transporting distance of sheets is longer with cases wherein the sheets are reversed with the reversal mechanism, in comparison with cases wherein sheets are not reversed at the reversal mechanism and discharged face-up. Accordingly, the processing capabilities (e.g., the number of sheets upon which images can be formed in a certain amount of time) of the image forming apparatus are reduced by a degree proportionate to the lengthened transporting path.

Also, even in the event that a sheet is to be discharged face-up and accordingly no reversal thereof is necessary, the sheet needs to wait in a case wherein the sheet preceding the face-up sheet is to be discharged face-down, in order to prevent the two sheets from colliding, overlapping, or the order thereof becoming inverted.

SUMMARY OF THE INVENTION

The present invention has been made in light of the above-described problems, and accordingly it is an object thereof to provide an image forming apparatus wherein the time required from supplying a recording medium to discharge thereof is reduced as much as possible without sacrificing suitable stacking of the recording medium even in the event of reversing the recording medium on which an image has been formed before discharging.

It is another object of the present invention to provide an image forming apparatus wherein control can be effected to change the discharge speed of the recording medium depending on whether a sheet discharge device has been connected to the image forming apparatus, thereby transporting recording sheets at a suitable speed according to whether or not a sheet discharge device has been connected.

It is a further object of the present invention to provide an image forming apparatus wherein the discharge speed for discharging the recording medium from a first transporting path and a second transporting path to a recording sheet stacking unit, and also setting a reverse transporting speed which is the speed of reverse transportation of the recording medium in the second transporting path till a reversal position where the recording medium is reverse, which is faster than the discharge speed, whereby the time required from supplying a recording medium to discharge thereof is reduced as much as possible without sacrificing suitable stacking of the recording medium even in the event of reversing the recording medium on which an image has been formed before discharging.

It is yet another object of the present invention to provide an image forming apparatus wherein the discharge speed is set to a first discharge speed which is slower than the reverse transportation speed in the event that determination is made that the sheet discharge device is not connected to the image forming apparatus, and set to a second discharge speed which is slower than the first discharge speed in the event that determination is made that the sheet discharge device is connected to the image forming apparatus, thereby transporting recording sheets at a suitable speed according to whether or not a sheet discharge device has been connected.

To achieve the above objects, according to a first aspect of the present invention, an image forming apparatus, to which a sheet discharge device can be detachably mounted, comprises: an image formation unit for forming images on a recording medium; a first transporting path for discharging a recording medium from the image formation unit to the sheet discharge device; a second transporting path for reversing the transportation direction of the recording medium so as to be discharged to the sheet discharge device, the second transporting path being longer than the first transporting path for discharging a recording medium from the image formation unit to the sheet discharge device; a transporting path switching unit for switching between transporting the recording medium to the first transporting path or the second transporting path; a setting unit for setting the discharge speed for discharging the recording medium from the first transporting path and the second transporting path to a recording sheet stacking unit, and also setting the reverse transportation speed for reversing the recording medium in the second transporting path; and a determining unit for determining whether or not the sheet discharge device has been connected to the image forming apparatus; wherein the setting unit sets the discharge speed to a first discharge speed which is slower than the reverse transportation speed in the event that determination is made by the determining unit that the sheet discharge device has not been connected to the image forming apparatus; and wherein the setting unit sets the discharge speed to a second discharge speed which is faster than the first discharge speed in the event that determination is made by the determining unit that the sheet discharge device has been connected to the image forming apparatus.

According to a second aspect of the present invention, an image forming apparatus to which a sheet discharge device can be detachably mounted, comprises: an image formation unit for forming images on a recording medium; a transporting path for discharging a recording medium from the image formation unit to the sheet discharge device; a setting unit for setting the discharge speed for discharging the recording medium from the transporting path to a recording medium stacking unit; and a determining unit for determining whether or not the sheet discharge device has been connected to the image forming apparatus; wherein the setting unit sets the discharge speed to a first discharge speed in the event that determination is made by the determining unit that the sheet discharge device has not been connected to the image forming apparatus; and wherein the setting unit sets the discharge speed to a second discharge speed which is faster than the first discharge speed in the event that determination is made by the determining unit that the sheet discharge device has been connected to the image forming apparatus.

According to a third aspect of the present invention, a control method, for an image forming apparatus to which a sheet discharge device can be detachably mounted and comprises an image formation unit for forming images on a recording medium, a first transporting path for discharging a recording medium from the image formation unit to the discharge device, and a second transporting path for reversing the transportation direction of the recording medium so as to be discharged to the sheet discharge device, the second transporting path being longer than the first transporting path for discharging a recording medium from the image formation unit to the sheet discharge device, comprises: a judging step for judging, based on printing information, whether to transport the recording medium to the first transporting path or to the second transporting path; a reversal transportation step for transporting the recording medium in reverse at a speed faster than the image formation speed in the event of transporting the recording medium to the second transporting path; a determining step for determining whether or not the sheet discharge device is connected to the image formation device; and a speed changing step for changing the discharging speed of the recording medium to a speed which is different from the reversal transportation speed, according to whether or not the sheet discharge device has been determined to have been connected in the determining step.

According to a fourth aspect of the present invention, a control method for an image forming apparatus to which a sheet discharge device can be detachably mounted, comprises: a determining step for determining whether or not the sheet discharge device has been connected to the image forming apparatus; a step for setting the discharge speed of the recording medium to a first discharge speed in the event that determination is made in the determining step that the sheet discharge device has not been connected to the image forming apparatus; and a step for setting the discharge speed of the recording medium to a second discharge speed which is faster than the first discharge speed in the event that determination is made in the determining step that the sheet discharge device has been connected to the image forming apparatus.

Further objects, features and advantages of the present invention will become apparent from the following description of the preferred embodiments with reference to the attached drawings.

BRIEF DESCRIPTION OF THE DRAWINGS

FIG. 6 is a flowchart illustrating transportation control of a recording sheet S.

FIG. 10 is a flowchart illustrating transport control of recording sheets S.

FIG. 11 is a flowchart illustrating transporting control of recording sheets S in the event that V1/2 has been set as the transporting speed of the recording sheets S by a main motor 123.

FIG. 13 is a diagram illustrating the transporting state for consecutively transporting recording sheets S at the reverse transporting unit 200.

FIG. 16 is a flowchart illustrating transport control of recording sheets S.

FIG. 17 is a flowchart illustrating transport control of recording sheets S in the event that the sheet discharge device 162 has not been connected to the main unit 101.

DESCRIPTION OF THE PREFERRED EMBODIMENTS

Embodiments of the present invention will be described in detail with reference to the drawings. The following embodiments will be described with reference to a laser beam printer which is an example of an image formation.

First Embodiment

Figure 1:
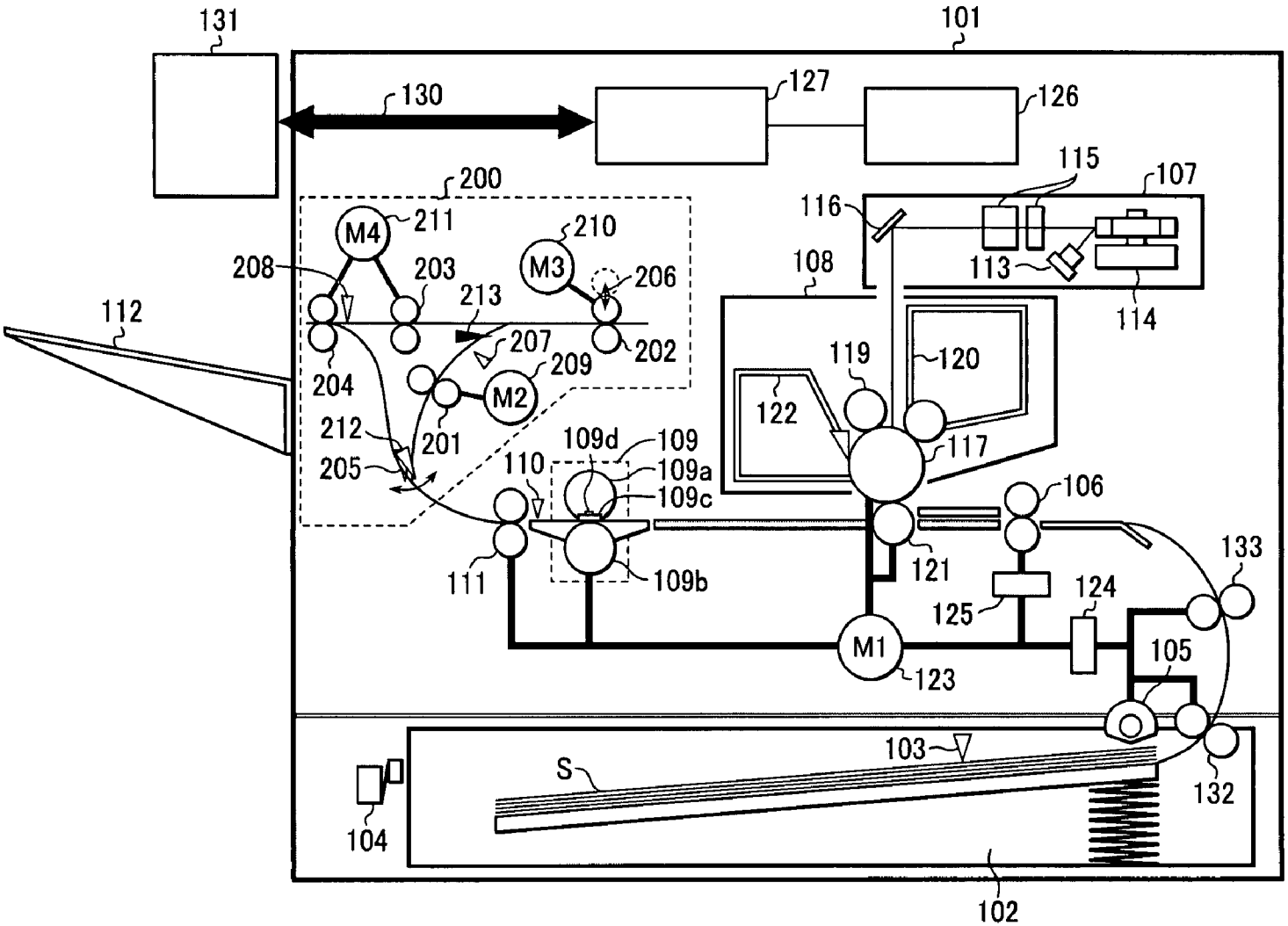
FIG. 1 is a cross-sectional view illustrating the configuration of a laser beam printer using an electrophotographic process.

FIG. 1 is a cross-sectional view illustrating the configuration of a laser beam printer using an electrophotographic process. A laser beam printer main unit 101 (hereafter referred to simply as "main unit 101") comprises a cassette 102 for storing recording sheets A serving as a recording medium, a cassette sheet sensor 103 for detecting whether or not recording sheets S are within the cassette 102, a cassette size sensor 104 for detecting the size of the recording sheets S within the cassette 102 (made up of multiple microswitches), a sheet supplying roller 105 for separating and supplying the recording sheets S one at a time from the cassette 102, and a feed roller 132 for transporting recording sheets S supplied from the sheet supplying roller 105.

In the drawing, reference numeral 106 denotes a resist roller pair for transporting the recording sheets S transported by the feed roller 132 and an intermediate roller 133.

Reference numeral 107 denotes a laser scanner unit, comprising a laser unit 113 for emitting laser beams modulated based on image signals (VDO signals) which are image signals sent from a later-described external device 131 which have been rendered, a polygon motor 114 for rotating a polygon mirror for scanning the laser beam from the laser unit 113 on a later-described photosensitive drum 117, an imaging lens 115 for imaging the laser beam from the polygon mirror on the photosensitive drum 117, and a reflecting mirror 116.

Also, downstream from the resist roller pair 106 in the transportation direction is provided a cartridge 108 for forming toner images on the recording sheets S based on the laser beam from the laser scanner unit 107. The cartridge 108 has a configuration for forming images on the recording sheets S using electrophotography, and comprises the photosensitive drum 117; a primary charging roller 119 for charging the surface of the photography drum 117 to a uniform potential; a developing unit 120 for developing electrostatic latent images, formed on the surface of the photography drum 117 due to being exposed by the laser beam, with toner; a transfer roller 121 for applying voltage of an inverse polarity as that of the toner to the photography drum 117 from the rear face of the recording sheets S, so as to transfer the toner image developed on the photography drum 117 onto the recording sheets S transported by the resist roller pair 106; and a cleaner 122 for recovering transfer-residual toner remaining on the photography drum 117 which was not transferred onto the recording sheet S by the transfer roller 121.

Further downstream from the cartridge 108 in the direction of transportation is a fixing unit 109 for thermally fixing the toner image formed on the recording sheets S, comprising a fixing film 109*a*, and pressure roller 109*b*, a ceramic heater 109*c* provided within the fixing film 109*a* for heating the toner image on the recording sheet S, and a thermistor 109*d* for detecting the surface temperature of the ceramic heater 109*c*.

Provided downstream from the fixing unit 109 in the direction of transportation is a fixing sensor 110 for detecting whether or not a recording sheet S is present, a fixing roller 111 for discharging a recording sheet S with a toner image fixed thereupon by the fixing unit 109, and, downstream of the fixing roller 111 in the transportation direction, a reversal transportation unit 200 for discharging the recording sheet S either face-up (hereafter abbreviated as "FU") or face-down (hereafter abbreviated as "FD") from the main unit 101.

Figure 2:
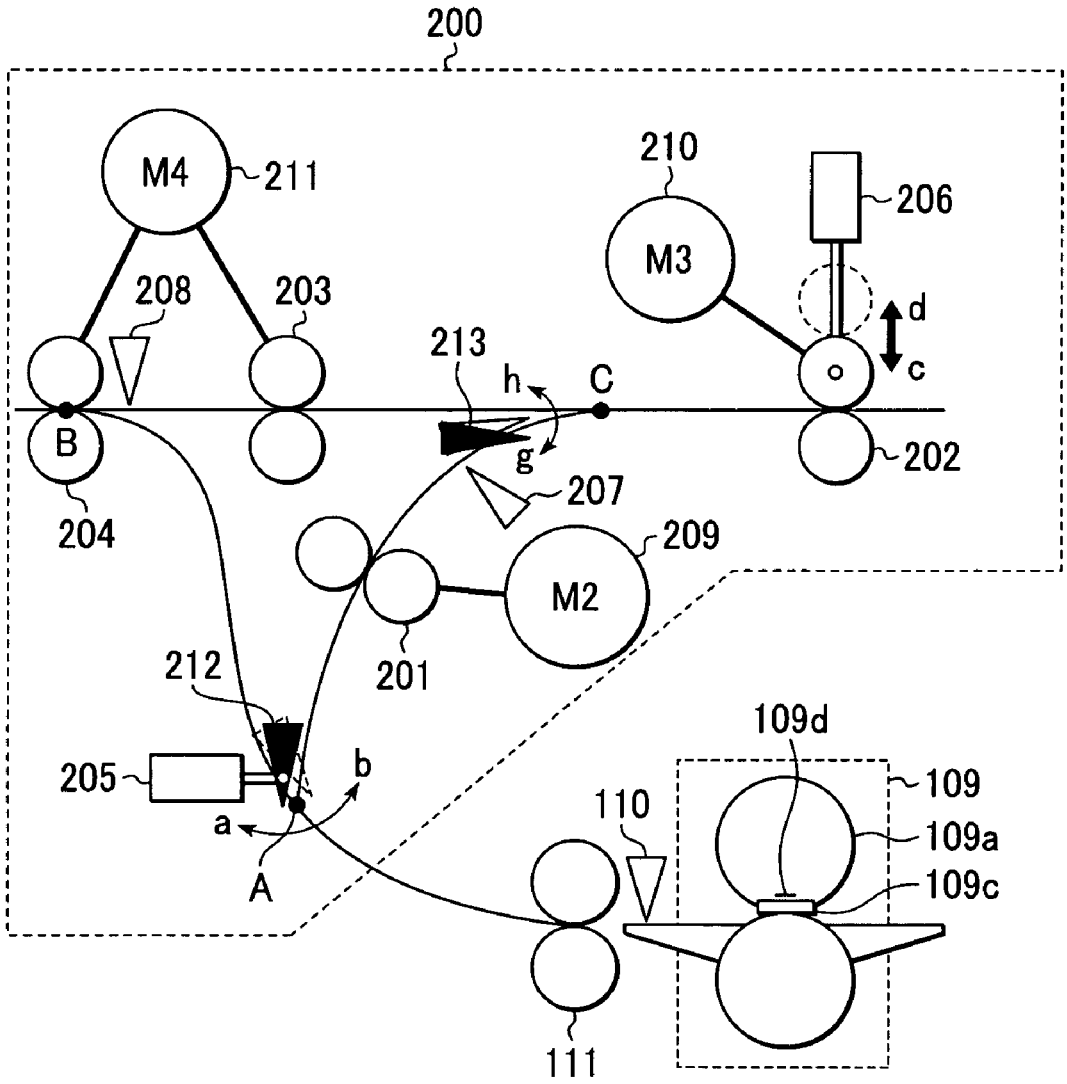
FIG. 2 is a cross-sectional view illustrating the configuration of a reverse transportation unit 200.

Now, the configuration of the reversal transportation unit 200 will be described with reference to FIG. 2. FIG. 2 is a cross-sectional view illustrating the configuration of the reversal transportation unit 200.

The reversal transportation unit 200 comprises an FU transportation path which is a first transportation path for discharging recording sheets S, which have passed through the fixing unit 109 with the image-formation face facing upwards, past point A and point B with the image-formation face still facing upwards, onto the stacking tray 112, and an FD transportation path which is a second transportation path for discharging recording sheets S, which have passed through the fixing unit 109 with the image-formation face facing upwards, from point A past point C and point B with the image-formation face facing downwards, onto the stacking tray 112.

The reversal transportation unit 200 further comprises a merging roller 201 driven by a merging motor 209, reversal rollers 202 driven by a reversal motor 210 so as to be capable of rotating in both the forward and reverse directions, an intermediate roller 203 driven by a discharge motor 211, a sheet discharge roller 204 driven by the same discharge motor 211, an FD/FU switchover flapper 212 for switching between whether to discharge recording sheets S to the stacking tray 112 via the FU transporting path or the FD transporting path, an FD/FU switchover solenoid 205 for switching the tip position of the FD/FU switchover flapper 212 between position a and position b in the drawing, a distancing solenoid 206 for switching the roller pair making up the reversal rollers 202 between a contacting state indicated by c in the drawing and a distanced state indicated by d in the drawing, a reversal sensor 207, disposed downstream from the merging roller 201 on the FD transporting path from point A to point B in the transporting direction, for detecting presence of a recording sheet S, and a sheet discharge sensor 208, disposed downstream from the intermediate roller 203 on the FD transporting path from point C to point B in the transporting direction, for detecting presence of a recording sheet S.

Also, reference numeral 213 denotes a reversal flapper, of which tip is at a position indicated by g in the drawing due to force of a spring or the like not shown in the drawing when a recording sheet S is not passing, and of which tip is at a position indicated by h in the drawing due to being pressed by a recording sheet S when a recording sheet S is passing. After the trailing end of the recording sheet S passes, the tip of the reversal flapper 213 returns to the original position g due to the force of the spring or the like. This reversal flapper 213 prevents recording sheets S to be transported from point C to point B from being unintentionally transported toward point A.

Further, the main unit 101 comprises a main motor 123. This main motor 123 supplies driving force to the components of the main unit 101, including the sheet supplying roller 105, feed roller 132, intermediate roller 133, resist roller 106, photosensitive drum 117, primary charging roller 119, transfer roller 121, fixing unit 109, sheet discharging roller 111, and so forth.

The sheet supply roller 105 and resist roller pair 106 are not always rotating whenever the main motor 123 is rotating, and are switched between a state wherein the driving force of the main motor 123 is transmitted thereto and a state wherein the driving force of the main motor 123 is not transmitted thereto, by means of a sheet supplying roller clutch 124 and resist roller clutch 125 which are turned on and off by a later-described engine controller 126, such that the recording sheets S are transported at a desired timing.

Figure 3:
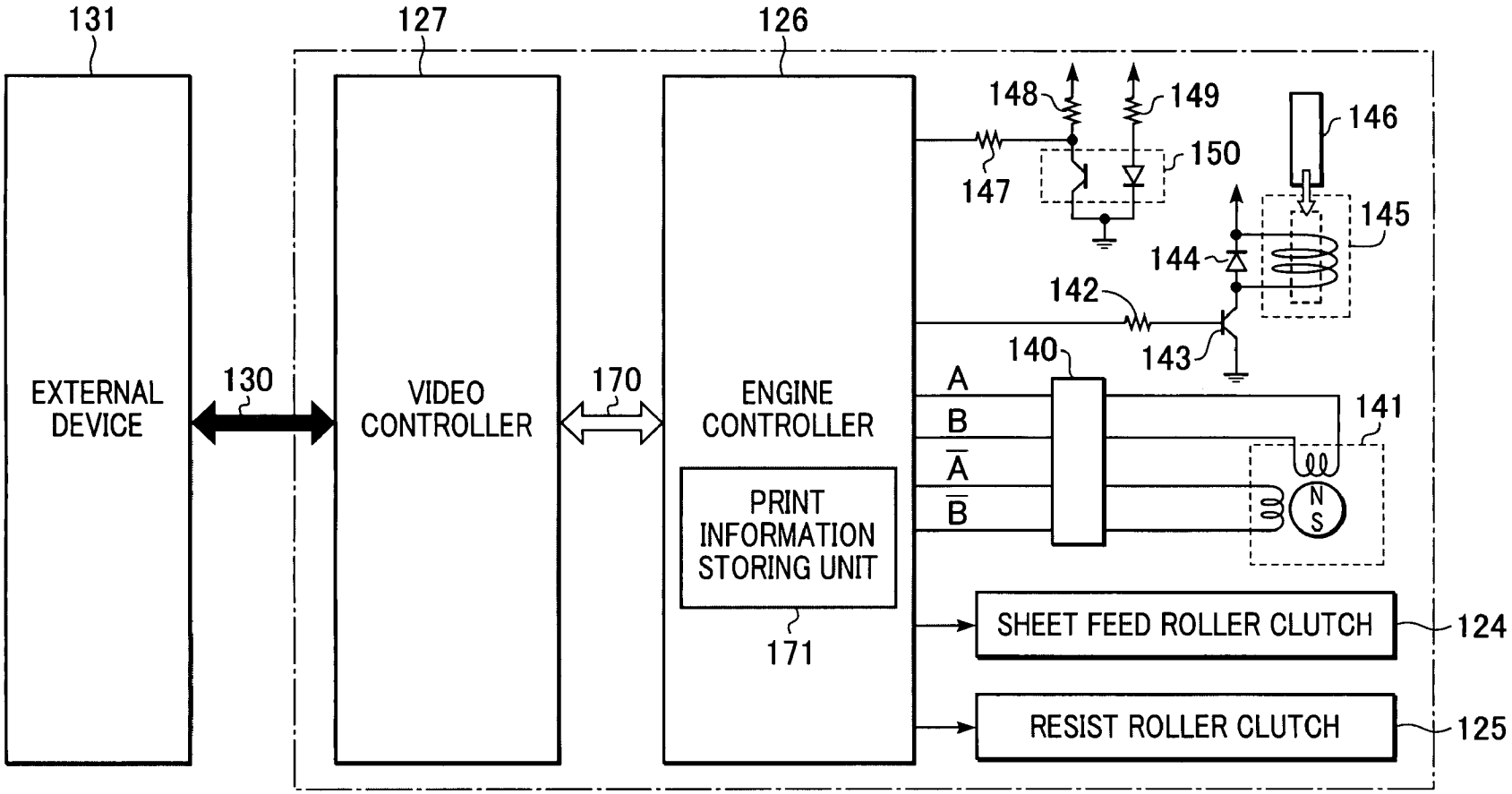
FIG. 3 is a block diagram illustrating the control configuration of a main unit 101.

Next, the control configuration of the main unit 101 will be described with reference to FIG. 3. FIG. 3 is a block diagram illustrating the control configuration of the main unit 101.

Reference numeral 131 denotes an external device such as a personal computer or the like, which transmits image information to be printed along with printing information (information regarding the size of the recording sheet S, sheet supply cassette specifying information, information regarding whether or not both-side printing is to be performed, and so forth) to the main unit 101 via a general-purpose interface 130 (Centronix, RS232C, etc.).

Reference numeral 127 denotes a video controller for rendering image information transmitted from the external device 131 into bit data so as to be converted into image signals (VDO signals), and transmits the VDO signals to the engine controller 126 via a video interface 170.

Reference numeral 126 denotes an engine controller for controlling the components of the main unit 101, and controls the charging bias applied to the primary charging roller 119, the amount of light of the lens unit 113, the rotations of the polygon motor 114, the developing bias applied to the developing roller making up the developing unit 120, and so forth, as well as also controlling the components related to transporting recording sheets S.

The motor 141, solenoid 145, and sensor 150 are actuator units making up the reversal transportation unit 200. The motor 141 as used here is a collective term for the merging motor 209, reversal motor 210, and discharge motor 211, and the solenoid 145 as used here is a collective term for the FD/FU switchover solenoid 205 and distancing solenoid 206. Further, the sensor 150 as used here is a collective term for the reversal sensor 207 and discharge sensor 208.

Figures 4, 5:
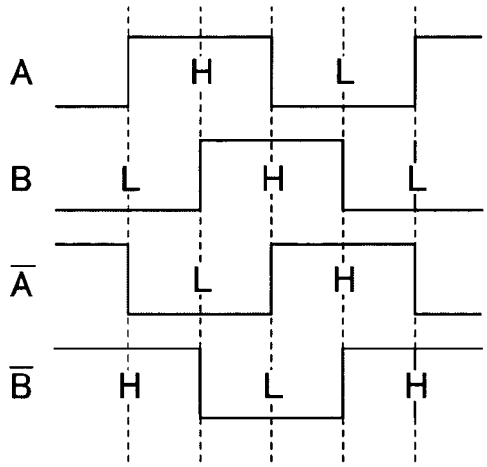
FIG. 4 is a diagram illustrating pulse signals transported from an engine controller 126 to a motor drive IC 140.
FIG. 5 is a diagram illustrating an example of printing information stored in a printing information storing unit 171 of an engine controller 126.

The merging motor 209, reversal motor 210, and discharge motor 211 of the reversal transportation unit 200 are stepping motors, and are driven by signals from the engine controller 126. As shown in FIG. 3, the engine controller 126 performs excitation switching of the stepping motors by transmitting pulse signals to the motor drive IC 140 as shown in FIG. 4 (biphasic excitation with the present embodiment). Upon receiving the pulse signals from the engine controller 126, the motor drive IC 140 controls the direction of the current in the coil of the motor 141 according to the pulse signals. At this time, the field magnetic polarity within the motor 141 is inverted, whereby the magnet is rotated.

The rotational speed of the motor 141 is dependent on the cycle of the pulse signals sent from the engine controller 126, and the shorter the pulse cycle is, the faster the inversion cycle of the field magnetic polarity within the motor 141 is, and the faster the motor 141 rotates.

Also, the engine controller 126 switches the FD/FU switchover solenoid 205 and the distancing solenoid 206 on and off by transmitting H/L signals thereto.

In FIG. 3, reference numeral 142 denotes a resistor, 143 denotes a transistor, and 144 a protective diode, so that in the event that the signals output from the engine controller 126 are H (high), the transistor 143 is on, and accordingly a magnetic field is generated by the current flowing to the coil of the solenoid 145 and the plunger 146 is drawn into the solenoid.

The plunger 146 of the FD/FU switchover solenoid 205 is connected to the tip of the FD/FU switchover flapper 212, and the engine controller 126 switches the signals output to the FD/FU switchover solenoid 205 between H and L sets the tip position of the FD/FU switchover flapper 212 to either the position a or b shown in FIG. 2, which accordingly sets the transporting path through which recording sheets are transported to the FD transporting path (wherein the tip of the FD/FU switchover flapper 212 is at the position a) or the FU transporting path (wherein the tip of the FD/FU switchover flapper 212 is at the position b).

The reversal sensor 207 and sheet discharge sensor 208 are photo-sensors for detecting the transportation state of the recording sheets. Upon a recording sheet S coming to the position of the sensor 150, a light-shielding member provided on the transporting path is pressed by the recording sheet S so that the light between the photo-diode and photo-transistor within the sensor 150 is shielded, and an H signal (meaning that a sheet is present with the present embodiment) is sent from the sensor 150 to the engine controller 126. On the other hand, in the event that there is no recording sheet S at the position of the sensor 150, an L signal (meaning that no sheet is present with the present embodiment) is sent from the sensor 150 to the engine controller 126.

Also, the engine controller 126 has, within a storage unit such as internal memory or the like, a printing information storage unit 171 for storing the aforementioned printing information input externally form the external device 131 via the video controller 127, and printing information specified from the video controller 127.

Next, an example of printing information stored in the printing information storage unit 171 will be described with reference to FIG. 5. FIG. 5 is a diagram illustrating an example of printing information stored in the printing information storage unit 171 of the engine controller 126.

Image information to be printed is transmitted from the external device 131, as well as printing information regarding image information of each of multiple pages being transmitted to the video controller 127 of the main unit 101. The printing information includes FD/FU specifications which specify whether the recording sheet S is to be discharged onto the stacking tray 112 with the image formation face downwards (FD) via the FD transporting path or to be discharged onto the stacking tray 112 with the image formation face upwards (FU) via the FU transporting path regarding each of the pages (page ID 1, 2, 3, and so forth), sheet supply opening specifications for supplying recording sheets S, sheet size indicating the size of the sheets, and so forth, as shown in FIG. 5. Note that FIG. 5 also indicates that an MP tray can be specified besides the cassette as a sheet supply opening specification. The MP tray is an unshown sheet supply opening for supplying recording sheets S from the right side of the main unit 101.

The printing information transmitted to the engine controller 126 via the vide controller 127 is stored in the printing information storage unit 171 of the engine controller 126. The engine controller 126 then performs image information for each page based on the printing information stored in the printing information storage unit 171 at the time of performing image formation on the recording sheets S. For example, with regard to the first page, a recording sheet S is supplied from the cassette 102 where A4-sized recording sheets S are stacked, and the recording sheet S upon which the image has been formed at the fixing unit 109 is discharged onto the stacking tray 112 face-down (FD) via the FD transporting tray. In FIG. 5, ten pages with page IDs 1 through 10 are shown, and each time image formation of a page is completed, printing information of the subsequent page is stored. It is needless to mention that the number of pages of which printing information can be stored in the printing information storage unit 171 is not restricted to ten pages, and can be any number of pages.

With the laser beam printer main unit 101 having the above-described configuration, the FD transporting path for transporting the recording sheets S to the stacking tray 112 following reversal (the distance from point A to point B via point C in FIG. 2) is longer than the FU transporting path (the distance from point A to point B in FIG. 2) wherein recording sheets S are transported to the stacking tray 112 without reversal.

Accordingly, in the event that the recording sheets S are transported at the same transporting speed through the FU transporting path and the FD transporting path, the time from supplying the recording sheets S to discharging the sheets on the stacking tray 112 through the FD transporting path is longer than through the FU transporting path.

On the other hand, with discharging face-down recording sheets S onto the stacking tray 112 via the FD transporting path, an arrangement may be conceived wherein the transportation speed of recording sheets S in the FD transporting path is faster than transporting through the FU transporting path by a certain set percentage. However, in this case, the discharge speed of recording sheets S from the FD transporting path is faster than the discharge speed of recording sheets S from the FU transporting path, the position on the stacking tray 112 where the recording sheets S are stacked is not the same (more specifically, the faster the discharging speed is, the farther away the discharged sheets S land on the stacking tray 112), so discharge sheet stacking becomes poor.

Accordingly, an object of the first embodiment is to reduce the time required from supplying a recording sheet S to discharge thereof as much as possible without sacrificing suitable stacking of the recording sheet S even in the event that the recording sheet S is discharged face-down (FD) via the FD transporting path, i.e., reversing the sheet recording sheet S and then discharging.

Transporting control of the recording sheet S which the engine controller 126 carries out will be described with reference to the flowchart shown in FIG. 6. FIG. 6 is a flowchart illustrating the transportation control of the recording sheet S.

FIG. 6 illustrates the actions carried out by the engine controller 126 from supplying one sheet of the recording sheets S from the cassette 102 up to discharging of the recording sheet S onto the stacking tray 112. In the event of printing multiple pages consecutively, the actions of the flowchart in FIG. 6 are understood to be executed in parallel for each page.

Figure 7A:
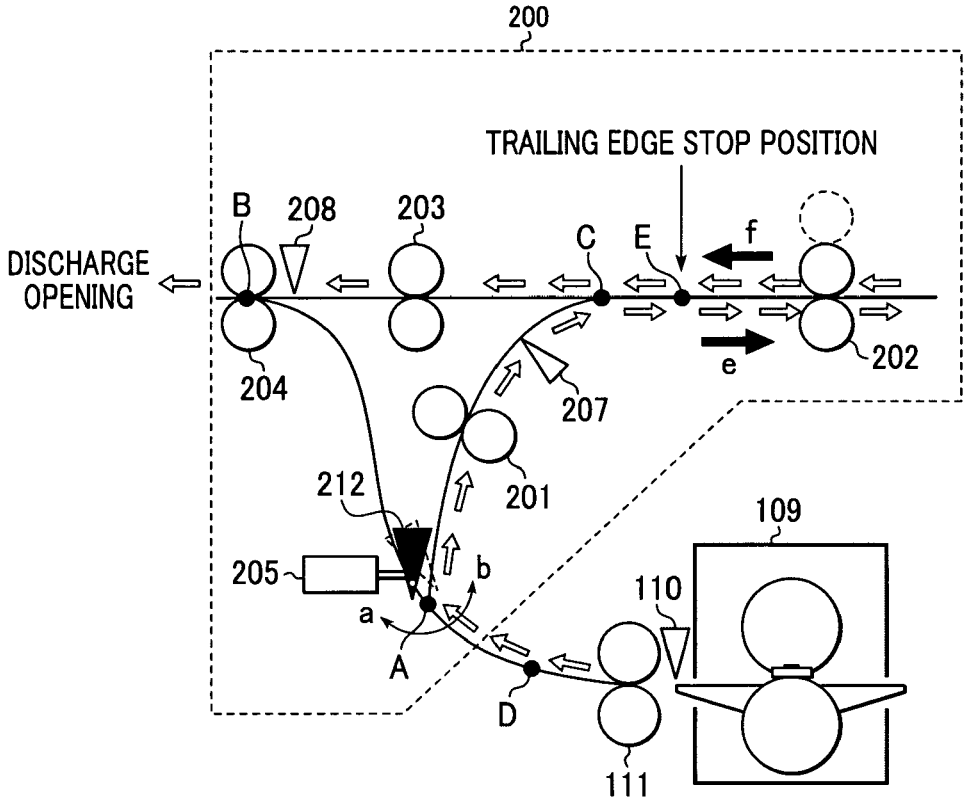
FIGS. 7A and 7B are diagrams illustrating the transporting path of the recording sheet S.
Figure 7B:
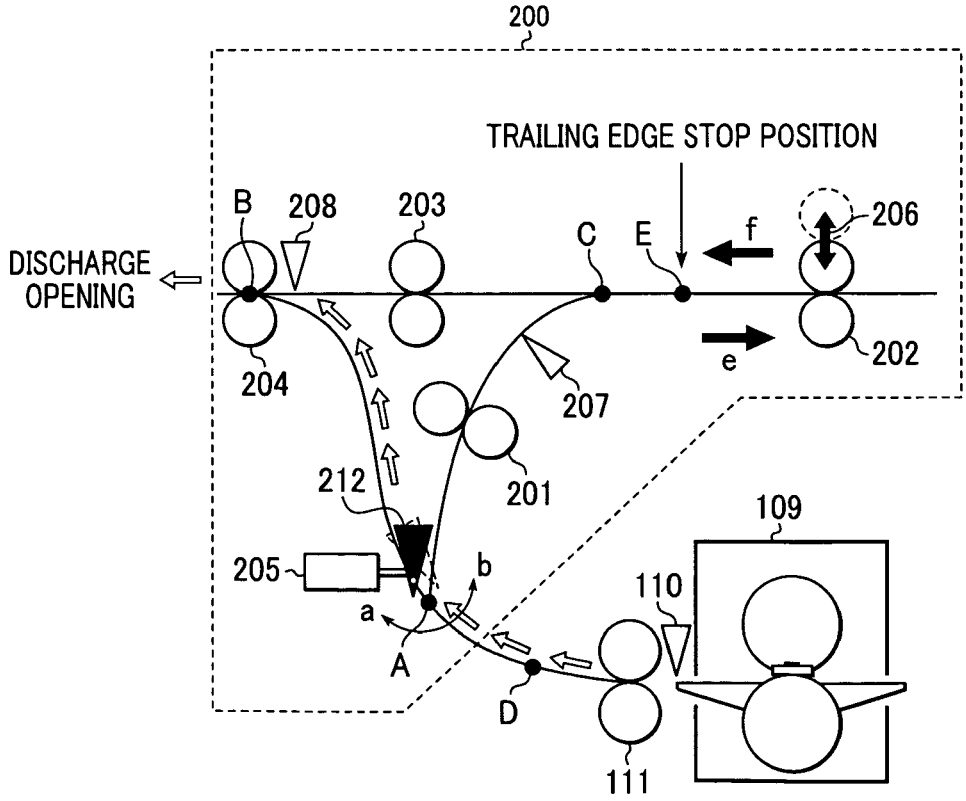

Also, FIGS. 7A and 7B are diagrams illustrating the transporting path of the recording sheet S in the event of passing through the FD transporting path and being discharged following the actions in the flowchart shown in FIG. 6. FIG. 7A illustrates the transporting path in the event that the recording sheet S is transported through the FD transporting path due to the FD transporting path having been specified, and FIG. 7B illustrates the transporting path in the event that the recording sheet S is transported through the FU transporting path due to the FU transporting path having been specified. Note that in the following description, the page to be printed is that having the page ID of 1 in the printing information in FIG. 5.

In step S601, the engine controller 126 makes reference to the printing information storage unit 171 at the time of starting image formation, and judges whether the specification for the discharge state set for the page to be printed is FD specification or FU specification. The page ID of the page to be printed is 1, so the engine controller 126 makes an FD specification for the discharge state.

In step S602, the engine controller 126 starts supply of the recording sheet S from the supply opening set for the sheet to be printed. The page ID of the page to be printed is 1, so the engine controller 126 supplies the recording sheet S from the cassette 102.

In step S603, the engine controller 126 performs image formation onto the recording sheet S. More specifically, the engine controller 126 applies charging bias to the primary charging roller 119 to uniformly charge the surface of the photosensitive drum 117, and forms an electrostatic latent image by exposing the photosensitive drum 117 with a laser beam emitted from the laser scanner unit 107 corresponding to image signals (VDO signals) corresponding to the page to be printed. The engine controller 126 then develops the electrostatic latent image formed on the photosensitive drum 117 so that a toner image is formed thereupon using the developing device 120, and subsequently effects control such that the toner image is formed onto the recording sheet S by transfer bias voltage having inverse polarity as to toner being applied to the transfer roller 121. Further, the engine controller 126 rotates the fixing film 109*a* and pressure roller 109*b* while maintaining the temperature of the ceramic heater 109*c* of the fixing unit 109 at a predetermined temperature based on the temperature detected by the thermistor 109*d*, so as to thermally fix the toner image onto the recording sheet S.

Now, the engine controller 126 maintains the speed of the main motor 123 at a constant speed so as to transport the recording sheet S supplied from the cassette 102 within the main unit 101 at a speed V1 (mm/sec) until the recording sheet S reaches the fixing unit 109. That is to say, the transporting speed which the main motor 123 applies to the recording sheet S with the present embodiment is always V1 (mm/sec) and never changes.

Next, FD discharge is specified for the sheet discharge state, so in step S604, the engine controller 126 sets the tip position of the FD/FU switchover flapper 212 to the position a within FIG. 7A using the FD/FU switchover solenoid 205 before the leading edge of the recording sheet S reaches point A in FIG. 7A. Upon the tip position of the FD/FU switchover flapper 212 being switched to the FD discharge side using the FD/FU switchover solenoid 205, the motors within the reversal unit 200 start driving.

In the first embodiment, the transporting speed applied to the recording sheet S by the merging roller 201 is set to V2 (=V1×1.03) in order to prevent the recording sheet S from sagging at the time of being handed from the fixing roller 111 to the merging roller 201, and the reversal roller 202 is also set to this speed, with the rotation speed of the merging roller 201 being controlled before the leading edge of the recording sheet S reaches the merging roller 201.

Next, in step S605, judgment is made by the engine controller 126 regarding whether or not the trailing edge of the recording sheet S has reached the point D in FIG. 7. Whether or not the trailing edge of the recording sheet S has reached the point D is judged according to whether or not a time T1 has elapsed following the trailing edge of the recording sheet S passing the fixing sensor 110.

Upon judgment being made in step S605 that the trailing edge of the recording sheet S has reached the point D, the engine controller 126 controls the rotation speed of the merging motor 209 and reversal motor 210 such that the transportation speed applied to the recording sheet S by the merging roller 201 (reversal transportation speed) is V3 (=V1×1.65) in step S606. Note that in step S605, the trailing edge of the recording sheet S has not reached the point E where the trailing edge of the recording sheet S is temporarily stopped in order to reverse the recording sheet S, so the transportation direction in which the reversal roller 202 is transporting the recording sheet S is in the direction e in FIG. 7A.

In step S607, the engine controller 126 judges whether or not the trailing edge of the recording sheet S has reached the point E. Judgment regarding whether or not trailing edge of the recording sheet S has reached the point E is made according to whether or not a time T2 has elapsed following the trailing edge of the recording sheet S passing the merging sensor 207.

In step S608, the engine controller 126 stops the rotations of the merging motor 209 and reversal motor 210 such that the rotations of the merging roller 201 and reversal roller 202 stop, since the trailing edge of the recording sheet S is determined to have reached the point E.

In step S609, the engine controller 126 reverses the rotational direction of the reversal roller 202 so as to discharge the recording sheet S to the stacking tray 112, and transports the recording sheet S in the direction f in FIG. 7A. The transporting speed at this time (discharging speed) is set to V2 (=V1×1.03).

The engine controller 126 turns the distancing solenoid 206 on at the point that the leading edge of the recording sheet S reaches the intermediate roller 203, so as to distance the reversal roller 202. The reason that the reversal roller 202 is distanced is that there are cases wherein multiple recording sheets S are consecutively printed, and a subsequent recording sheet S may be transported to the reversal roller 202 while a preceding recording sheet S is being transported in the direction f by the reversal roller 202. In the event that the reversal roller 202 is in a contacting state in such a case, this will result in jamming, so the reversal roller 202 is distanced to avoid such a situation.

Also, the engine controller 126 switches the rotations of the reversal roller 202 to forward rotation (the direction e in FIG. 7A) following which the distancing solenoid 206 is turned off, whereby the reversal roller 202 is switched from the distanced state to the contacting state such that the recording sheet S being subsequently transported can be transported.

In step S610, the engine controller 126 determines whether or not the trailing edge of the recording sheet S has passed point B from the detection results of the trailing edge of the recording sheet S from the discharge sensor 208, and in the event that determination is made that the trailing edge of the recording sheet S has passed point B, the actions regarding the recording sheet S with the page ID of 1 end.

Next, the actions regarding a recording sheet S with a page ID of 9 in FIG. 5 will be described. In the event that the page ID is 9 here, FU is specified for the FD/FU specifications, as shown in FIG. 5.

Accordingly, in step S601, the engine controller 126 judges that FU sheet discharge is specified unlike the case of the page ID 1, and the flow proceeds to step S611.

In step S611, the engine controller 126 starts supplying a recording sheet S from the MP tray which is the supply opening specified regarding page ID 9.

In step S612, the engine controller 126 performs image formation onto the recording sheet S. More specifically, the engine controller 126 executes the actions described in step S603. Subsequently, the engine controller 126 sets the tip position of the FD/FU switchover flapper 212 to the position b within FIG. 7B using the FD/FU switchover solenoid 205 before the leading edge of the recording sheet S reaches point A in FIG. 7B, since FU is specified as the discharge state.

In step S613, the engine controller 126 sets the transporting speed of the recording sheet S by the discharge roller at this time (discharging speed) to V2 (=V1×1.03), and starts driving of the discharging motor 211.

In the first embodiment, the transporting speed applied to the recording sheet S by the discharge roller 204 is set to V2 (=V1×1.03) in order to prevent the recording sheet S from sagging at the time of being handed from the fixing roller 111 to the discharge roller 204, and the reversal roller 202 is also set to this speed, with the rotation speed of the discharge roller 204 being controlled before the leading edge of the recording sheet S reaches the discharge roller 204.

In step S614, the engine controller 126 determines whether or not the trailing edge of the recording sheet S has passed the point B from the detection results of the trailing edge of the recording sheet S from the discharge sensor 208, and in the event that determination is made that the trailing edge of the recording sheet S has passed the point B, actions regarding the recording sheet S with the page ID of 9 ends.

Figure 8:
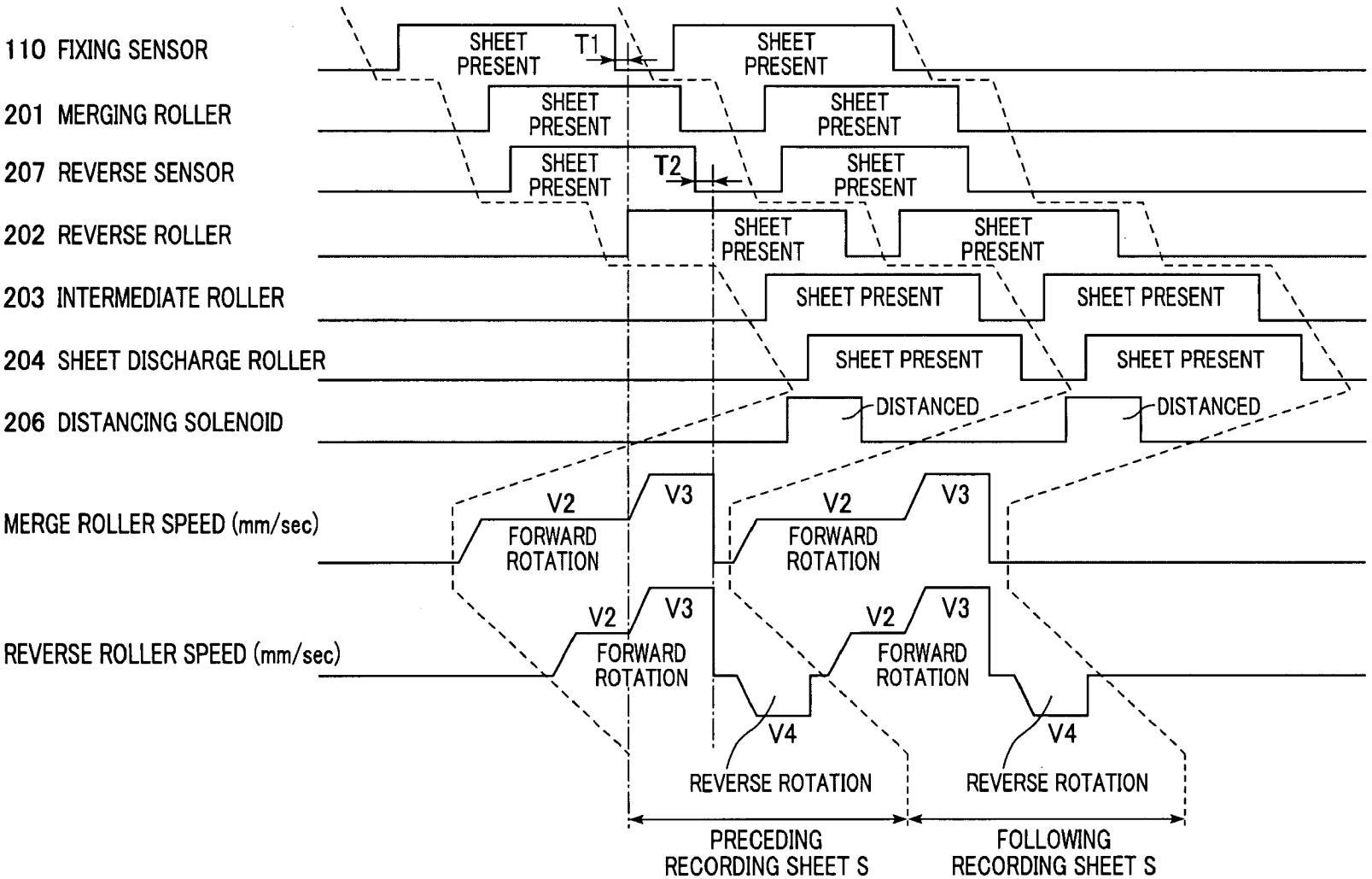
FIG. 8 is a timing chart illustrating a case of discharging two recording sheets 2 regarding which face-down discharge has been specified, to a stacking tray 112 via a face-down transporting path.

The above-described transporting actions of the recording sheets S are illustrated in the timing chart in FIG. 8. FIG. 8 is a timing chart illustrating discharging two recording sheets S regarding which FD has been specified as FD/FU specifications, to the stacking tray 112 via the FD transporting path.

In FIG. 8, the fixing sensor 100, merging roller 201, reversal sensor 207, reversal roller 202, intermediate roller 203, and discharge roller 204 are high-level at the point that a recording sheet S is present at each component (the portions regarding which sheets are indicated as being present in FIG. 8), and low-level in the event that no recording sheet S is present.

Also, in FIG. 8, the state in which the reversal roller 202 is separated (the state d in FIG. 2) is high-level (the portion indicated as distanced in FIG. 8) at the distancing solenoid 206, and low-level in the state that the reversal roller 202 is in contact (the state indicated by c in FIG. 2).

Also, in FIG. 8, regarding the merging roller speed and reversal roller speed, V2 and V3 indicate the rotation speed in the forward rotation direction of the rollers (the direction e in FIG. 2), and V4 indicates the rotation speed in the reverse direction of the reversal roller 202 (the direction f in FIG. 2).

Figure 9A:
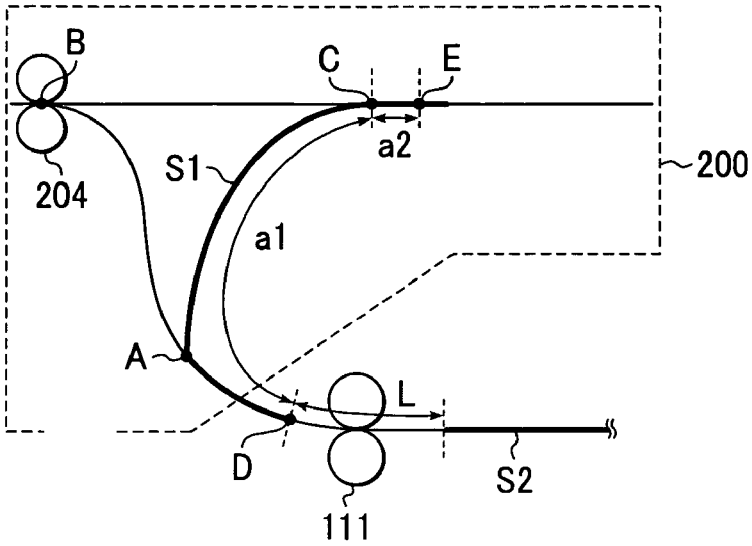
FIGS. 9A through 9C are diagrams illustrating the transporting state for consecutively transporting recording sheets S at the reverse transporting unit 200.
Figure 9B:
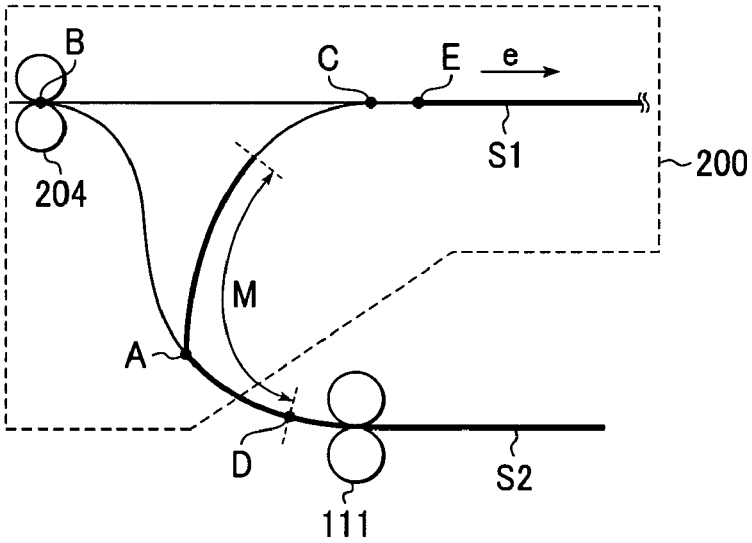
Figure 9C:
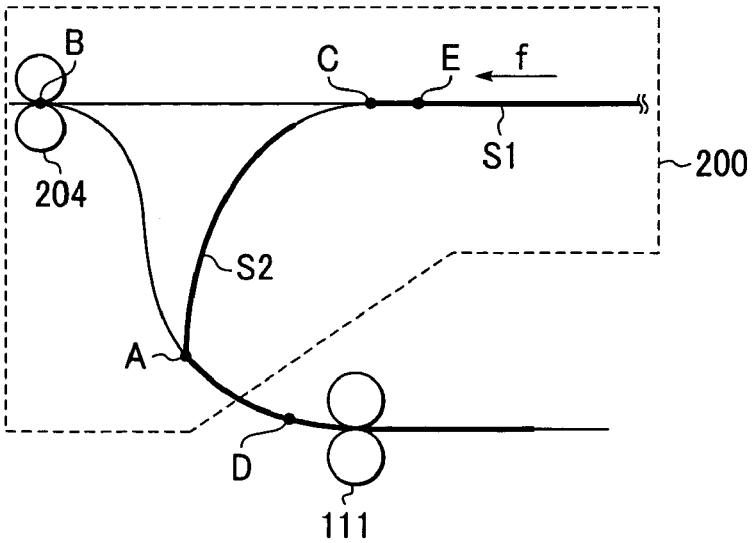

A description has been made above regarding a case wherein the speed is increased from V2 to V3 upon the trailing edge of the recording sheet S passing point D in FIG. 2 in the event of transporting the recording sheet S through the FD transporting path, and now the method for setting the speed V3 for increasing the speed will be described with reference to FIGS. 9A through 9C. FIGS. 9A through 9C illustrate the transportation state for consecutively transporting recording sheets S at the reverse transportation unit 200.

In FIG. 9A, a1 denotes the transportation distance on a transportation path from point D to point C via point A, and a2 denotes the transportation distance on a transportation path from point C to point E. Also, L represents the transportation interval of recording sheets S being consecutively transported. Further, a preceding recording sheet S will be denoted by S1, and a subsequent recording sheet S will be denoted by S2.

Also, FIG. 9B illustrates the transportation state of a recording sheet S after time T1 has elapsed from the state shown in FIG. 9A, and FIG. 9C illustrates the transportation state of a recording sheet S after time T2 has elapsed from the state shown in FIG. 9B.

First, the speed for transporting the recording sheet S1, which has the trailing edge at the point D, with the merging roller 201, is V3, and accordingly, the following relational expression holds.

$$T1=(a1+a2)/V3 \quad \text{(Expression 1)}$$

Also, the distance M from point D in FIG. 9B to the leading edge of the recording sheet S2 can be calculated by the following expression since the transportation speed of the recording sheet S2 by the merging roller 201 is V2.

$$M=T1\cdot V2-DL=(a1+a2)\cdot V2/V3-DL \quad \text{(Expression 2)}$$

wherein DL is the distance to point D based on the fixing roller 111.

Next, the amount of time required for reversing the recording sheet S1 in the direction f with the reversal roller 202 from the position of the recording sheet S1 shown in FIG. 9B and transporting the recording sheet S1 to the point C is time T2, and accordingly the following relational expression holds. As described earlier, the speed for transporting the recording sheet S1 in the direction f is V2.

$$T2=a2/V2 \quad \text{(Expression 3)}$$

The engine controller 126 reverses the recording sheet S1 in the direction f as shown in FIG. 9C, and transports the subsequent recording sheet S2. In this case, collision between the recording sheet S1 transported in the direction f and the leading edge of the recording sheet S2 would cause transportation problems such as jamming or the like. This can be avoided by causing the leading edge of the recording sheet S2 to pass the point C following the leading edge of the recording sheet S1 has passed the point C. In this case, the recording sheet S1 and the recording sheet S2 do come into contact, but the leading edges of the recording sheets S do not collide.

The following relational expression must be satisfied to realize the above relation.

$$(a1-M)>a2 \quad \text{(Expression 4)}$$

From the above Expressions 1 through 4, V3 should be set so as to satisfy the following conditions.

$$V3>[(a1+a2)/(a1-a2+d)]\cdot V2 \quad \text{(Expression 5)}$$

Setting the transportation speed of the recording medium thus enables collision of the leading edges of the preceding recording sheet S1 and the following recording sheet S2 in the transportation direction even in the event that multiple recording sheets S are being transported in the FD transporting path.

Second Embodiment

Next, a second embodiment of the present invention will be described. This second embodiment is a modification of the first embodiment, and components not described in particular here, including the configuration of the main unit 101, are to be understood to be of the same configuration as described in the first embodiment, and also to operate in the same manner.

In the first embodiment, the engine controller 126 maintained the speed of the main motor 123 at a constant speed so as to effect transportation at a speed of V1 (mm/sec) until the recording sheet S supplied from the cassette 102 within the main unit 101 reaches the fixing unit 109. Conversely, with the second embodiment, the engine controller 126 selects between an action of maintaining transportation at the speed of V1 (mm/sec) until the recording sheet S supplied from the cassette 102 within the main unit 101 reaches the fixing unit 109, and an action wherein the transportation speed is half, i.e., V1/2.

FIGS. 10 and 11 are flowchart illustrating the transportation control of a recording sheet S in the second embodiment.

Before starting image formation, the engine controller 126 sets the speed for transporting the recording sheet S to either V1 or V1/2 using the main motor 123. A case wherein V1/2 would be set for the speed for transporting the recording sheet S is a case wherein the printing information transmitted from the external device 131 specifies that the type of the recording sheet S is an OHT (Overhead Transparency), for example.

In step S1000, the engine controller 126 proceeds to step S1001 in the event that the type of the recording sheet S is plain paper in the printing information for example, and proceeds to step (1) in the event that the type of the recording sheet S is an OHT in the printing information for example.

Steps S1001 through S1014 are the same as steps S601 through S614 in the first embodiment, and accordingly description thereof will be omitted here.

In the event that the transportation speed of the recording sheet S by the main motor 123 is set to V1/2 in step S1000, the engine controller 126 executes the actions shown in FIG. 11. FIG. 11 is a flowchart illustrating transportation of the recording sheet S in the event that V1/2 has been set as the transportation speed of the recording sheet S by the main motor 123.

Steps S1101 through S1113 in FIG. 11 corresponding to steps S601 through S613 in FIG. 6, with the transportation speed of the recording sheet S differing in Step S1104 and step S1113.

In step S1104, the engine controller 126 controls the transportation speed of the recording sheet S to a speed V2 (=V1×0.5×1.03) to correspond to the transportation speed of the recording sheet S by the main motor 123, rather than the speed (V1×1.03) in step S604.

Also, in step S1113, the engine controller 126 controls the transportation speed of the recording sheet S to a speed V2 (=V1×0.5×1.03) to correspond to the transportation speed of the recording sheet S by the main motor 123, rather than the speed (V1×1.03) in step S613.

Note that the transportation speeds V3 and V2 of the recording sheet S in steps S1106 and S1109 are set to the same speeds as with steps S1006 and S1009 in FIG. 10, even though the transportation speed of the recording sheet S by the main motor 123 is V1/2.

Next, the actions in step S1105, S1114, and S1115 will be described. In step S1105, the engine controller 126 judges whether or not the trailing edge of the recording sheet S has reached the point D in FIG. 7. Whether or not the recording sheet S has reached point D is judged by the result whether or not time (T1×2) has elapsed after the trailing edge of the recording sheet S passed the fixing sensor 110.

In step S1114, whether or not the trailing edge of the recording sheet S has reached point D is determined, and in the event that this has reached point D, the transportation speed of the recording sheet S is changed to V4 (=V1×1.03) in step S1115.

Control in steps S1106 through S1110 and S1116 is the same as in FIG. 10, and accordingly description thereof will be omitted here.

As described above, according to the second embodiment, the transportation speed at the reverse transportation unit 200 of the recording sheet S handed from the fixing roller 111 is switched to V2 in the event that the transportation speed of the recording sheet S by the main motor 123 switches between V1 and 1/2, so sagging of the recording sheet S at the time of the fixing roller 111 handing the recording sheet S to the merging roller 201 or discharge roller 204 of the reverse transportation unit 200 can be prevented.

Also, even in the event that the transportation speed of the recording sheet S by the main motor 123 switches between V1 and V1/2, the discharge speed of the recording sheet S from the main unit 101 to the stacking tray 112 is the same V4 regardless whether being discharged from the FD transporting path or the FU transporting path, so the recording sheets S are neatly stacked on the stacking tray 112.

Third Embodiment

Next, a third embodiment of the present invention will be described. This third embodiment is a modification of the first embodiment, and components not described in particular here, including the configuration of the main unit 101, are to be understood to be of the same configuration as described in the first embodiment, and also to operate in the same manner.

Figure 12A:
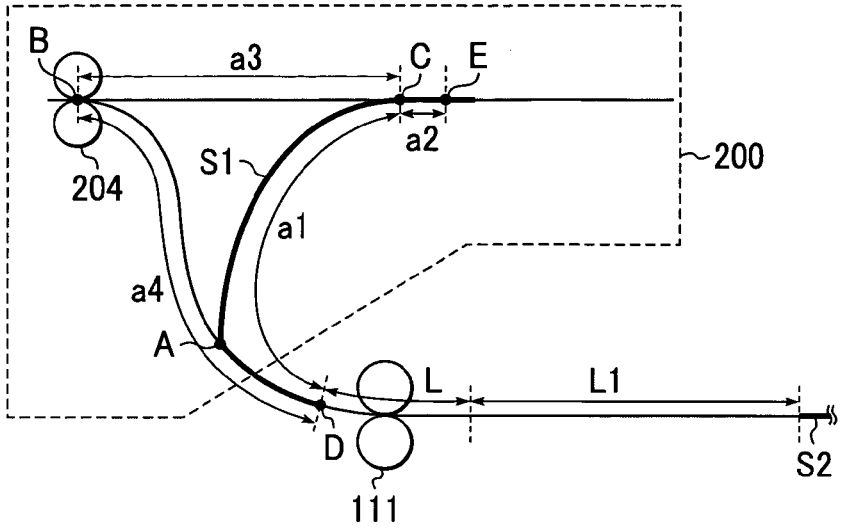
FIGS. 12A through 12C are diagrams illustrating the transporting state for consecutively transporting recording sheets S at the reverse transporting unit 200.
Figure 12B:
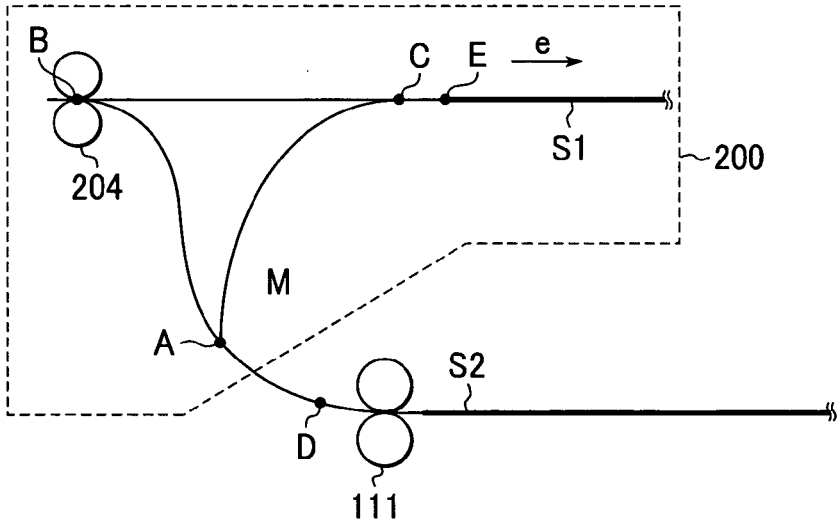
Figure 12C:
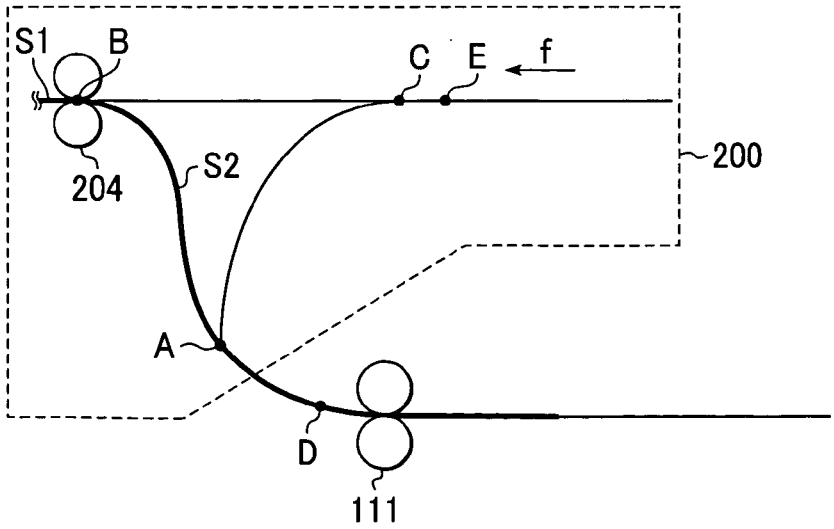

FIGS. 12A through 12C are diagrams illustrating the transportation state of consecutively transporting recording sheets S with the reverse transporting unit 200.

In FIG. 12A, in the event that a recording sheet S1 is to be transported through the FD transporting path, a1 +a2 (mm) is required for transporting the trailing edge of the recording sheet S1 from the reference position point D to the reversal position point E, and a2+a3+SL (mm) is required for the trailing edge of the recording sheet S1 at the point E to further switch directions from the transportation direction e to the transportation direction f and the trailing edge of the recording sheet S1 to pass the point B. Note that SL represents the length of the recording sheet S1 in the transportation direction.

Accordingly, the recording sheet S1 needs to be transported by a1+2·a2+a3+SL (mm) in order for the trailing edge of the recording sheet S1 to be transported from the state wherein the trailing edge is at the point D to the state wherein the trailing edge of the recording sheet S1 passes the point B.

On the other hand, in FIGS. 12B and 12C, in the event that a recording sheet S2 is to be transported through the FU transporting path, a4 (mm) is necessary for the trailing edge of the recording sheet S2 to be transported from the reference position point D to point B. The distance on the transportation path for the trailing edge of the recording sheet S2 to be transported from the reference position point D to point B is as shown in the following relational expression.

$$a4<a1+2\cdot a2+a3+SL \quad \text{(Expression 6)}$$

With an apparatus having a configuration such as in Expression 6, there may be cases wherein a recording sheet S1 which is discharged from the longer FD transporting path, is discharged following discharging of a recording sheet S2 discharged from the FU transporting path, even though the recording sheet S1 was intended to be discharged before the recording sheet S2.

Accordingly, the normal transporting interval L between the recording sheet S1 and the recording sheet S2 needs to be replaced with (L+L1) wherein L1 has been added to L, so that the discharge order of the recording sheets S is not incorrect in the event of discharging the recording sheet S2 from the FU transporting path after the recording sheet S1 from the FD transporting path.

The way for setting the transporting interval L1 between the recording sheet S1 and the recording sheet S2 will be described with reference to FIGS. 12A through 13.

FIGS. 12A through 12C are diagrams illustrating the transportation state of consecutively transporting recording sheets S with the reverse transporting unit 200.

In FIGS. 12A through 12C, the recording sheet S1 is discharged to the stacking tray 112 through the FD transporting path, and the recording sheet S2 is discharged to the stacking tray 112 through the FU transporting path.

In FIG. 12A, a1 denotes the transportation distance on a transportation path from point D to point C via point A, and a2 denotes the transportation distance on a transportation path from point C to point E. Also, a3 denotes the transportation distance on the transportation path from point C to point B, and a4 denotes the transportation distance from point D to point B via point A.

Also, FIG. 12B illustrates the transportation state of a recording sheet S after time T1 has elapsed from the state shown in FIG. 12A, and FIG. 12C illustrates the transportation state of a recording sheet S after time T3 has elapsed from the state shown in FIG. 12B.

First, the speed for transporting the recording sheet S1, which has the trailing edge at the point D, with the merging roller 201, is V3, and accordingly, the following relational expression holds.

$$T1=(a1+a2)/V3 \quad \text{(Expression 7)}$$

Also, time T3 is required to switch back the recording sheet S1 in the direction f and for the trailing edge of the recording sheet S1 to pass over the point B, so the following relational expression holds.

$$T3=(a3+a3+SL)/V2 \quad \text{(Expression 8)}$$

On the other hand, with the time required from increasing the speed from V2 to V3 in the state of the preceding recording sheet S1 as shown in FIG. 13A to the leading edge of the following recording sheet S to each the point B as T4, the following relational expression holds.

$$T4=(L+L1+a4)/V1 \quad \text{(Expression 9)}$$

Now, in order to maintain the order of pages for discharging the recording sheet S1 and the recording sheet S2 to the stacking tray 112, the transportation interval (L +L1) between the recording sheet S1 and the recording sheet S2 should be determined such that the leading edge of the recording sheet S2 reaches point B following the trailing edge of the recording sheet S1 passing point B. Accordingly, the following relational expression should be satisfied.

$$T1+T3<T4 \quad \text{(Expression 10)}$$

Further, from Expressions 7 through 10, L1 should be determined so as to satisfy the following conditions.

$$L1>(a1+a2)\cdot V1/V3+(a2+a3+SL)\cdot V1/V2-a4-L \quad \text{(Expression 11)}$$

Thus, replacing the normal transporting interval L between the recording sheet S1 and the recording sheet S2 with L+L1 enables recording sheets S to be stacked on the stacking tray 112 with the correct order of recording sheets S maintained even in the event of discharging a recording sheet S2 from the FU transporting path following discharging a recording sheet S1 from the FD transporting path.

FIG. 13 is a diagram illustrating the transporting state of consecutively transporting recording sheets S with the reverse transporting unit 200, showing the actions for controlling the transporting interval between the recording sheet S1 and the recording sheet S2 using L1 which is set so as to satisfy the conditions in Expression 11.

The following is a description regarding the control of the recording sheet S2 following the preceding recording sheet S1. In FIG. 13, steps S1301 through S1310 correspond to steps S601 through S610 in FIG. 6 described with the first embodiment, and accordingly description thereof will be omitted here.

In step S1311, the engine controller 126 judges whether or not FD discharge has been specified regarding the recording sheet S1 preceding the recording sheet S2 regarding which FU discharge has been specified in step S1301. The engine controller 126 determines whether or not FD discharge has been specified for the preceding recording sheet S1 based on the printing information stored in the printing information storage unit 171.

In the event that the engine controller 126 determines that FD discharge has been specified for the recording sheet S1 preceding the recording sheet S2, the flow proceeds to step S1312.

In step S1312, the engine controller 126 stands by till a timing wherein the transportation interval between the trailing edge of the preceding recording sheet S1 and the leading edge of the following recording sheet S2 is L+L1, and then supplies the recording sheet S2 from the cassette 102 by transmitting driving force of the main motor 123 to the sheet supply roller 105 by driving the sheet supply roller clutch 124.

On the other hand, in the event that the engine controller 126 has determined in step S1311 that FU discharge has been specified for the recording sheet S1 preceding the recording sheet S2, the flow proceeds to step S1313. In the event of skipping step S1312 and executing step S1313, the recording sheet S2 is supplied from the cassette 102 by transmitting driving force of the main motor 123 to the sheet supply roller 105 by driving the sheet supply roller clutch 124, at a timing wherein the transportation interval between the trailing edge of the preceding recording sheet S1 and the leading edge of the following recording sheet S2 is L.

Steps S1314 through S1316 correspond to steps S612 through S614 in FIG. 6 described with the first embodiment, and accordingly description thereof will be omitted here.

Thus, in the event of discharging a preceding recording sheet S1 from the FU transporting path and a following recording sheet S2 also from the FU transporting path, the transporting interval between the recording sheet S1 and the recording sheet S2 is L. On the other hand, in the event of discharging the preceding recording sheet S1 from the FD transporting path and the following recording sheet S2 from the FU transporting path, the transporting interval between the recording sheet S1 and the recording sheet S2 is L+L1.

Thus, setting the transporting interval between the preceding recording sheet S1 and the following recording sheet S2 as described above enables the order of discharging the recording sheet S1 and recording sheet S2 onto the stacking tray 112 to be maintained even in the event of discharging the preceding recording sheet S1 from the longer FD transporting path and the following recording sheet S2 from the shorter FU transporting path.

Fourth Embodiment

Figure 14:
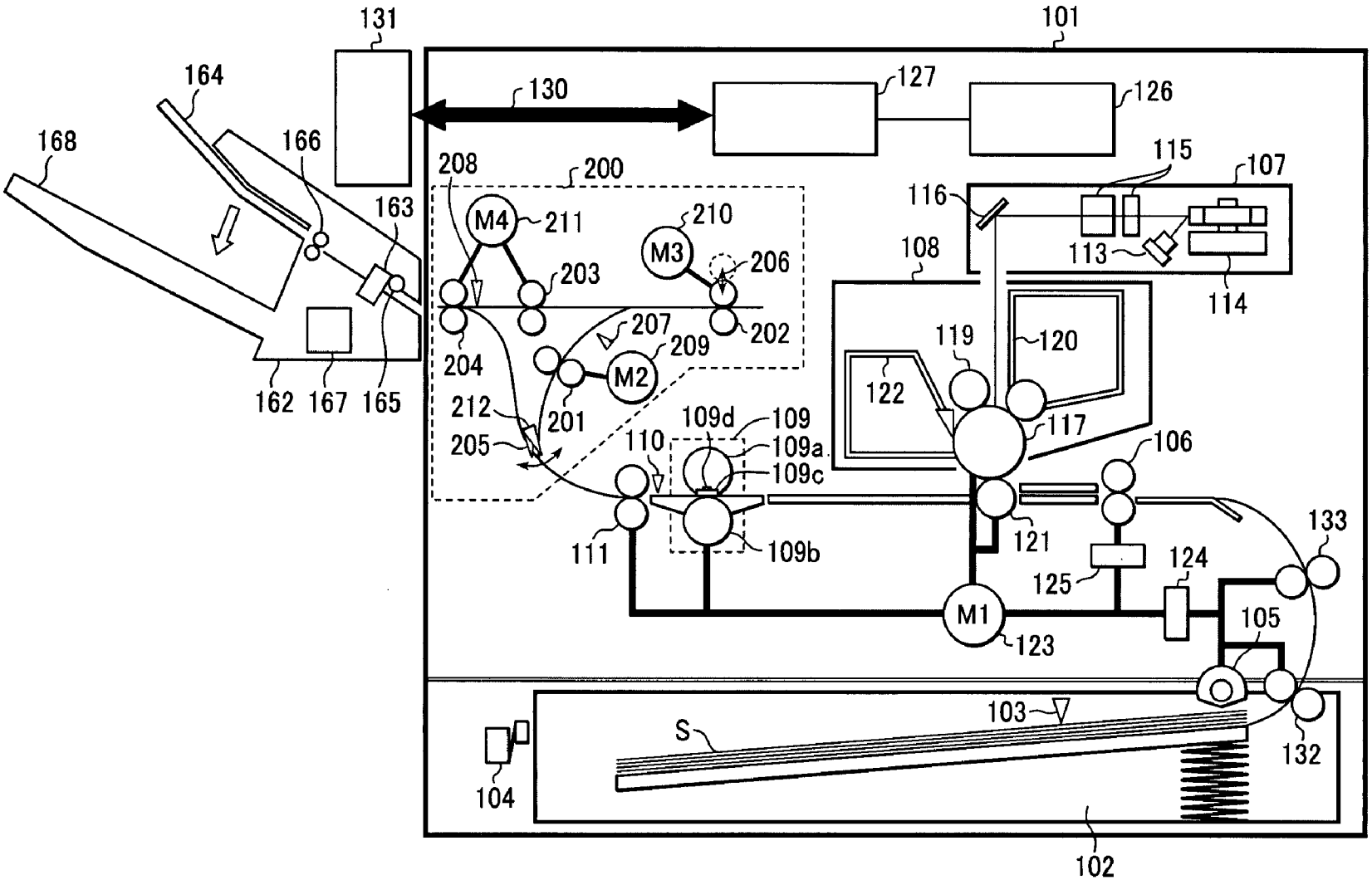
FIG. 14 is a cross-sectional view illustrating the configuration of a laser beam printer using an electrophotographic process.

Next, a fourth embodiment of the present invention will be described. This fourth embodiment is a modification of the first embodiment, and components not described in particular here, including the configuration of the main unit 101, are to be understood to be of the same configuration as described in the first embodiment, and also to operate in the same manner. The fourth embodiment differs from the first embodiment in that a sheet discharge device 162 can be detachably mounted to the main unit 101, as shown in FIG. 14.

The sheet discharge device 162 comprises a transporting roller 165 for transporting recording sheets S discharged from the discharge roller 204 of the main unit 101, a stapler 163 for stapling multiple recording sheets S transported by the transporting roller 165, which is a type of post-processing, a discharge roller 166 for discharging stapled and unstapled recording sheets S to a straightening tray 164, a discharge tray 168, a discharge device control unit 167 for controlling an unshown motor which drives the transporting roller 165 and stapler 163 and discharge roller 204 and the like, and so forth.

Note that the discharge device control unit 167 is controlled based on the printing information and the like from the video controller 127, as with the engine controller 126.

Also, the straightening tray 164 straightens the recording sheets S in the width direction of the recording sheets S by an unshown straightening motor, and also discharges the straightened recording sheets S onto the discharging tray 168 by dropping in the direction indicated by the arrow in the drawing.

Figure 15A:
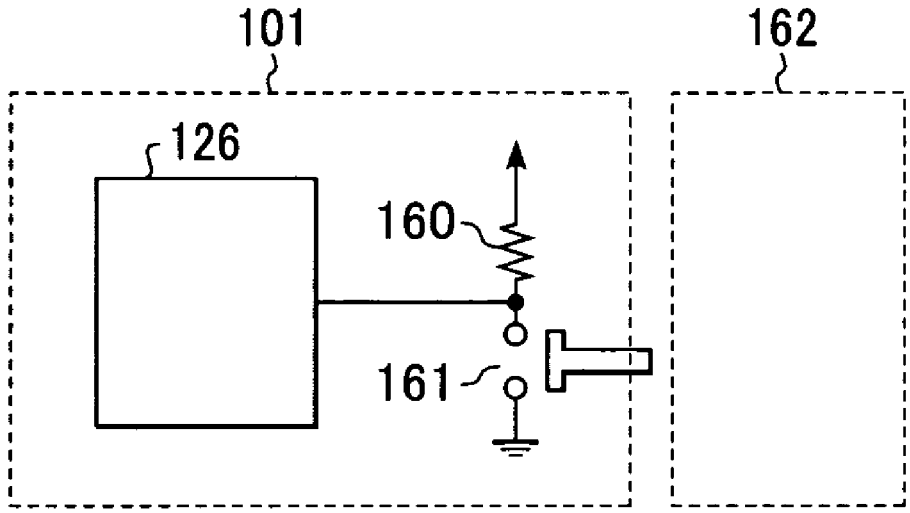
FIGS. 15A and 15B are diagrams illustrating a circuit configuration for detecting whether or not a sheet discharge device 162 has been connected to the main unit 101.
Figure 15B:
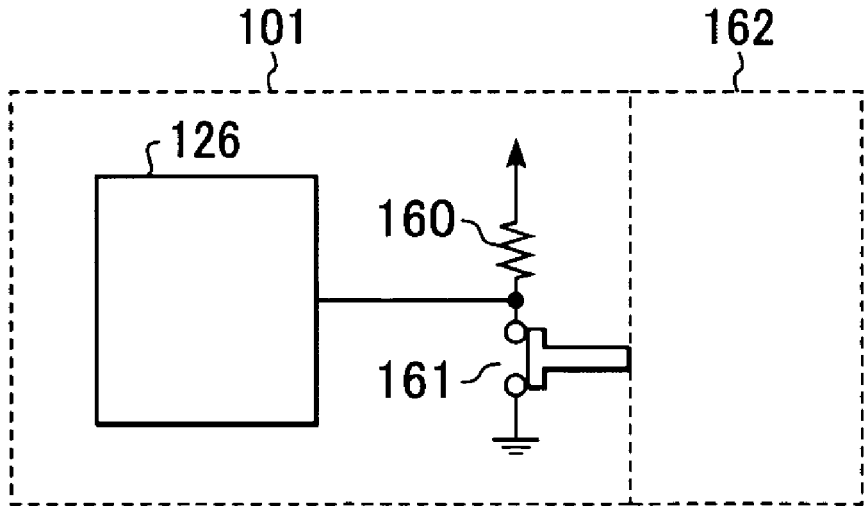

FIGS. 15A and 15B are diagrams illustrating a circuit configuration for detecting whether or not the discharge device 162 has been connected to the main unit 101.

The engine controller 126 has a pull-up resistor 160 and switch 161 connected thereto, and in the event that the discharge device 162 is not connected to the main unit 101, a high-level (H level) signal is transmitted to the engine controller 126 via the pull-up resistor 160 (FIG. 15A).

On the other hand, in the event that the discharge device 162 is connected to the main unit 101, the switch 161 is turned on due to the discharge device 162 being connected, and a low-level (L level) signal is transmitted to the engine controller 126. That is to say, the engine controller 126 monitors whether the signals from the circuit made up of the pull-up resistor 160 and switch 161 are high-level or low-level signals, and accordingly can determine whether the discharge device 162 is connected to the main unit 101.

Next, the operations according to the fourth embodiment will be described with reference to FIGS. 16 and 17. FIGS. 16 and 17 are flowcharts illustrating the transporting control of recording sheets S in the fourth embodiment.

In step S1600, the engine controller 126 determines whether or not the discharge device 162 is connected to the main unit 101 before starting image formation. In the event that the engine controller 126 determines that the discharge device 162 is connected to the main unit 101, the flow proceeds to step S1601.

Steps S1601 through S1610 correspond to steps S601 through S610 in the flowchart in FIG. 6 described with the first embodiment, but the step S1609 for setting the discharge speed for discharging recording sheets S from the main unit 101 differs.

In step S1609, the engine controller 126 sets the transportation speed of the recording sheet S to reverse transportation at V3 (=V1×1.65). The reason that the transporting speed of the recording sheet S is set to V3 is to discharge the recording sheet S to the discharge device 162 at a timing corresponding to time necessary for the straightening operations at the straightening tray 164 of the discharge device 162 (hereafter referred to as "post-processing time").

Specifically, in the event that the discharge device is a staple stacker for example, the staple stacker straights the sheets before stapling. A predetermined amount of time is necessary for this straightening action, so the discharge speed is set to V3 (V1×1.65) to increase the interval with subsequent recording sheets, in order to effect control such that no subsequent recording sheets are delivered while performing the straightening actions.

With the present embodiment, description has been made regarding a configuration wherein the discharge speed of the recording sheet S is set to V3 (V1×1.65) which is the same as with reverse transportation in the event the sheet discharge device is mounted, but the discharge speed does not need to be the same speed as the reverse transportation speed, and may be set to the transporting speed of the discharge device, or a speed different to V3 according to the processing speed.

Moreover, it should be noted that the discharge device here is not restricted to a staple stacker, and the present embodiment can be applied to other optional devices in the same way.

In the event that the engine controller 126 determines in step S1601 that the recording sheet S is specified for FU discharge, the flow proceeds to step S1611.

Steps S1611 through S1613 correspond to steps S611 through S613 in the flowchart in FIG. 6 described with the first embodiment, and accordingly description thereof will be omitted here. However, steps S1614 and on differ from those in the first embodiment.

In step S1614, the engine controller 126 determines whether or not the trailing edge of the recording sheet S has reached the point D. This is to determine whether or not the trailing edge of the recording sheet S has cleared the fixing roller 111, so that there is no catching of the recording sheet S among multiple rollers even in the event that the transporting speed of the recording sheet S is increased.

Upon the trailing edge of the recording sheet S having reached the point D in step S1614, the engine controller 126 sets the transporting speed of the recording sheet S by the discharge roller 204 to V3 (=V1×1.65).

Subsequently, in step S1616, the engine controller 126 determines whether or not the trailing edge of the recording sheet S has passed point B, and upon the trailing edge of the recording sheet S having passed point B, the flow ends, determining that discharge of the recording sheet S has ended.

The above steps S1601 through S1616 illustrate transporting control in a case wherein the discharge device 162 is connected to the main unit 101.

The steps S1701 through S1714 indicating the case wherein the discharge device 162 is not connected to the main unit 101 in step S1600 are the same as steps S601 through S614 in the flowchart in FIG. 6.

Accordingly, in the event that the discharge device 162 is not connected to the main unit 101, recording sheets S are discharged to the stacking tray 112 from the main unit 101 at the discharge speed V2 (=V1×1.03).

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus to which a sheet discharge device can be detachably mounted, said apparatus comprising:

an image formation unit for forming images on a recording medium;

a first transporting path for discharging a recording medium from said image formation unit to said sheet discharge device;

a second transporting path for reversing the transportation direction of said recording medium so as to be discharged to said sheet discharge device, said second transporting path being longer than said first transporting path for discharging a recording medium from said image formation unit to said sheet discharge device;

a transporting path switching unit for switching between transporting said recording medium to said first transporting path or said second transporting path;

a setting unit for setting the discharge speed for discharging said recording medium from said first transporting path and said second transporting path to a recording sheet stacking unit, and also setting the reverse transportation speed for reversing said recording medium in said second transporting path; and a determining unit for determining whether or not said sheet discharge device has been connected to said image forming apparatus;

wherein said setting unit sets said discharge speed to a first discharge speed which is slower than said reverse transportation speed in the event that determination is made by said determining unit that said sheet discharge device has not been connected to said image forming apparatus; and wherein said setting unit sets said discharge speed to a second discharge speed which is faster than said first discharge speed in the event that determination is made by said determining unit that said sheet discharge device has been connected to said image forming apparatus.

2. An image forming apparatus according to claim 1, wherein said second discharge speed is a speed corresponding to the sheet discharge device mounted to said image forming apparatus.

3. An image forming apparatus according to claim 1, wherein said sheet discharge device includes a device for straightening or stapling sheets of said recording medium.

4. An image forming apparatus according to claim 1, wherein said setting unit sets a third speed which is faster than the image formation speed at said image formation unit and slower than said reversal transportation speed, in the event of transporting said recording medium from said image transporting unit to said second transporting path.

5. A control method for an image forming apparatus to which a sheet discharge device can be detachably mounted and comprises an image formation unit for forming images on a recording medium, a first transporting path for discharging a recording medium from said image formation unit to said discharge device, and a second transporting path for reversing the transportation direction of said recording medium so as to be discharged to said sheet discharge device, said second transporting path being longer than said first transporting path for discharging a recording medium from said image formation unit to said sheet discharge device;

said method comprising:

a judging step for judging, based on printing information, whether to transport said recording medium to said first transporting path or to said second transporting path;

a reversal transportation step for transporting said recording medium in reverse at a speed faster than the image formation speed in the event of transporting said recording medium to said second transporting path;

a determining step for determining whether or not said sheet discharge device is connected to said image forming apparatus; and a speed changing step for changing said discharging speed of said recording medium to a speed which is different from said reversal transportation speed, according to whether or not said sheet discharge device has been determined to have been connected in said determining step.

6. An image formation control method according to claim 5, wherein said speed changing step sets said discharge speed to a first discharge speed which is slower than said reverse transportation speed in the event that determination is made in said determining step that said sheet discharge device has not been connected to said image forming apparatus, and sets said discharge speed to a second discharge speed which is faster than said first discharge speed in the event that determination is made in said determining step that said sheet discharge device has been connected to said image forming apparatus.

7. An image formation control method according to claim 5, further comprising a transporting step for transporting said recording medium from said image formation unit to said second transporting path at a speed which is slower than said reversal transporting speed and faster than said image formation speed.

8. An image formation control method according to claim 5, wherein said sheet discharge device includes a device for straightening or stapling sheets of said recording medium.

9. An image forming apparatus to which a sheet discharge device can be detachably mounted, said apparatus comprising:

an image formation unit for forming images on a recording medium;

a transporting path for discharging a recording medium from said image formation unit to said sheet discharge device;

a setting unit for setting the discharge speed for discharging said recording medium from said transporting path to a recording medium stacking unit; and a determining unit for determining whether or not said sheet discharge device has been connected to said image forming apparatus;

wherein said setting unit sets said discharge speed to a first discharge speed in the event that determination is made by said determining unit that said sheet discharge device has not been connected to said image forming apparatus; and wherein said setting unit sets said discharge speed to a second discharge speed which is faster than said first discharge speed in the event that determination is made by said determining unit that said sheet discharge device has been connected to said image forming apparatus.

10. An image forming apparatus according to claim 9, wherein said second discharge speed is a speed corresponding to the sheet discharge device mounted to said image forming apparatus.

11. An image forming apparatus according to claim 9, wherein said sheet discharge device includes a device for straightening or stapling sheets of said recording medium.

12. A control method for an image forming apparatus to which a sheet discharge device can be detachably mounted, said method comprising:

a determining step for determining whether or not said sheet discharge device has been connected to said image forming apparatus;

a step for setting the discharge speed of said recording medium to a first discharge speed in the event that determination is made in said determining step that said sheet discharge device has not been connected to said image forming apparatus; and a step for setting said discharge speed of said recording medium to a second discharge speed which is faster than said first discharge speed in the event that determination is made in said determining step that said sheet discharge device has been connected to said image forming apparatus.

13. An image forming apparatus to which a sheet discharge device can be detachably mounted, the apparatus comprising:

an image formation portion configured to form images on a recording medium at an image formation speed;

a first transporting path configured to discharge a recording medium from the image formation portion to the sheet discharge device;

a second transporting path configured to reverse the transportation direction of the recording medium so as to be discharged to the sheet discharge device, the second transporting path being longer than the first transporting path for discharging a recording medium from the image formation portion to the sheet discharge device;

a transporting path switching member for switching between transporting the recording medium to the first transporting path or the second transporting path;

a setting portion configured to set a discharge speed for discharging the recording medium from the first transporting path and the second transporting path to a recording sheet stacking unit, and also configured to set a reverse transportation speed for reversing the recording medium in the second transporting path; and a determining unit configured to determine whether or not the sheet discharge device has been connected to the image forming apparatus;

wherein the reverse transportation speed is faster than the image forming speed, wherein when the sheet is discharged from the second transporting path, the setting portion sets the discharge speed to a first speed which is slower than the reverse transportation speed in the event that a determination is made that the sheet discharge device has not been connected to the image forming apparatus, and the setting portion sets the discharge speed to a second speed which corresponds to a processing time of the sheet discharge device in the event that a determination is made that the sheet discharge device has been connected to the image formation apparatus.

14. The image forming apparatus according to claim 13, wherein the sheet discharge device includes a device for straightening or stapling sheets of the recording medium.

15. A control method for an image forming apparatus to which a sheet discharge device can be detachably mounted, the image forming apparatus including an image formation unit configured to form images on a recording medium; a first transporting path configured to discharge a recording medium from the image formation unit to the discharge device; and a second transporting path configured to reverse the transportation direction of the recording medium so as to be discharged to the sheet discharge device, the second transporting path being longer than the first transporting path for discharging a recording medium from the image formation unit to the sheet discharge device, the method comprising:

judging, based on printing information, whether to transport the recording medium to the first transporting path or to the second transporting path;

transporting the recording medium in reverse at a reverse transportation speed faster than the image formation speed in the event of transporting the recording medium to the second transporting path;

determining whether or not the sheet discharge device is connected to the image forming apparatus;

setting a sheet discharge speed to a first transportation speed which is lower than the reverse transportation speed in the event that a determination is made that the sheet discharge device has not been connected to the image forming apparatus; and setting the sheet discharge speed to a second transportation speed which corresponds to a processing time of the sheet discharge device in the event that a determination is made that the sheet discharge device has been connected to the image forming apparatus.

16. The image formation control method according to claim 15, further comprising transporting the recording medium from the image formation unit to the second transporting path at a speed which is slower than the reverse transportation speed and faster than the image formation speed.

17. The image formation control method according to claim 16, wherein the sheet discharge device includes a device for straightening or stapling sheets of the recording medium.

18. An image forming apparatus to which a sheet discharge device can be detachably mounted, the apparatus comprising:

an image formation portion configured to form images on a recording medium;

a transporting path configured to discharge a recording medium from the image formation portion to the sheet discharge device;

a setting portion configured to set a discharge speed for discharging the recording medium from the transporting path to a recording medium stacking unit; and a determining unit configured to determine whether or not the sheet discharge device has been connected to the image forming apparatus;

wherein the setting portion sets the discharge speed to a first discharge speed in the event that a determination is made that the sheet discharge device has not been connected to the image formation apparatus, wherein the setting portion sets the discharge speed to a second discharge speed which corresponds to a processing time of the sheet discharge device in the event that a determination is made that the discharge device has been connected to the image forming apparatus.

19. An image forming apparatus according to claim 18, wherein the sheet discharge device includes a device for straightening or stapling sheets of the recording medium.

20. A control method for an image forming apparatus to which a sheet discharge device can be detachably mounted, the method comprising:

determining whether or not the sheet discharge device has been connected to the image forming apparatus;

setting the discharge speed of the recording medium to a first discharge speed in the event that determination is made that the sheet discharge device has not been connected to the image forming apparatus; and setting the discharge speed to a second discharge speed which corresponds to a processing time of the sheet discharge in the event that a determination is made that the sheet discharge device has been connected to the image forming apparatus.

* * * * *